US011672359B2

(12) United States Patent
Jain et al.

(10) Patent No.: US 11,672,359 B2
(45) Date of Patent: Jun. 13, 2023

(54) DISPLAY DEVICE FOR ILLUMINATING PACKAGED BEVERAGES

(71) Applicant: PepsiCo, Inc., Purchase, NY (US)

(72) Inventors: Sandeep Jain, Gurgaon (IN); Gurmeet Singh Bhutani, Gurgaon (IN)

(73) Assignee: PepsiCo, Inc., Purchase, NY (US)

( * ) Notice: Subject to any disclaimer, the term of this patent is extended or adjusted under 35 U.S.C. 154(b) by 0 days.

(21) Appl. No.: 17/377,048

(22) Filed: Jul. 15, 2021

(65) Prior Publication Data

US 2022/0015555 A1 Jan. 20, 2022

(30) Foreign Application Priority Data

Jul. 17, 2020 (IN) ..... 202041030501

(51) Int. Cl.

| | |
|---|---|
| ***A47F 3/00*** | (2006.01) |
| ***A47F 7/28*** | (2006.01) |
| ***A47F 1/12*** | (2006.01) |
| ***A47F 3/04*** | (2006.01) |

(52) U.S. Cl.

CPC ..... *A47F 3/001* (2013.01); *A47F 1/126* (2013.01); *A47F 3/0426* (2013.01); *A47F 7/28* (2013.01)

(58) Field of Classification Search

CPC ..... A47F 3/001; A47F 3/0426; A47F 7/28; A47F 1/126

See application file for complete search history.

(56) References Cited

U.S. PATENT DOCUMENTS

| | | | |
|---|---|---|---|
| 3,506,325 | A | 4/1970 | Horvay |
| 5,197,610 | A | 3/1993 | Bustos |
| 5,590,945 | A | 1/1997 | Simms |
| 6,231,205 | B1 | 5/2001 | Slesinger et al. |
| 6,464,089 | B1 | 10/2002 | Rankin, VI |
| 8,322,544 | B2 | 12/2012 | Hardy |
| 9,814,325 | B1 | 11/2017 | Mendre |
| 2009/0021927 | A1 | 1/2009 | Hall et al. |
| 2009/0195136 | A1 | 8/2009 | Wing et al. |
| 2015/0023000 | A1 | 1/2015 | Kendall et al. |
| 2019/0376655 | A1 | 12/2019 | Sburlan |

OTHER PUBLICATIONS

International Search Report and Written Opinion of the International Searching Authority in International Application No. PCT/US2021/041851, dated Oct. 26, 2021 (12 pages).

*Primary Examiner* — Thomas M Sember

(74) *Attorney, Agent, or Firm* — Sterne, Kessler, Goldstein & Fox P.L.L.C.

(57) ABSTRACT

A display device for illuminating a packaged beverage includes a panel having a front end opposite a rear end. The panel further includes a top surface on which a packaged beverage may be placed, and the top surface has transparent portions. A light source is arranged within the panel for illuminating the packaged beverage arranged on the top surface of the panel. The display device further includes an end cap having a front wall arranged at the front end of the panel.

19 Claims, 17 Drawing Sheets

DISPLAY DEVICE FOR ILLUMINATING PACKAGED BEVERAGES

FIELD

Embodiments described herein generally relate to devices for displaying products. Specifically, embodiments described herein relate to a display device for illuminating packaged beverages.

BACKGROUND

Display cabinets, coolers, and the like are often used to store and display products for purchase by consumers. Products may be arranged in the display cabinet to promote visibility of the products while also providing storage of additional products. Display cabinets often have open front walls, or glass panels to allow consumers to view the products available for purchase. However, such display cabinets may do little to attract the attention of consumers, and may not highlight the products available for purchase. Thus, the display cabinet may not help to attract consumers and entice consumers to make purchases.

SUMMARY OF THE INVENTION

Some embodiments described herein relate to display system for packaged beverages that includes a display rack having a frame, a first platform configured to support the packaged beverages, and a second platform configured to support the packaged beverages, wherein the second platform is arranged in a plane parallel to and spaced from a plane of the first platform. The display rack includes a first display device arranged on the first platform, and a second display device arranged on the second platform. Each of the first and second display devices includes a panel configured to support the packaged beverages having a front end opposite a rear end, and a light source arranged on the panel and beneath the packaged beverages for illuminating the packaged beverages.

In any of the various embodiments discussed herein, the first platform may include a channel configured to receive the first display device.

In any of the various embodiments discussed herein, the display rack may further include a stopper arranged on the frame for securing the display rack to a support surface.

In any of the various embodiments discussed herein, the display rack may further include a gravity dispenser arranged on the first platform, wherein the gravity dispenser comprises a base that is sloped.

In any of the various embodiments discussed herein, the display rack may further include a spring-driven dispenser arranged on the first platform, wherein the spring-driven dispenser comprises a base and a tab driven by a spring.

In any of the various embodiments discussed herein, the first and second display devices may each in communication with a control unit configured to selectively illuminate the first and second display devices.

Some embodiments described herein relate to a display device for illuminating a packaged beverage that includes a panel configured to support the packaged beverages, wherein the panel has a front end opposite a rear end, and a top surface having a plurality of transparent portions. The display device further includes a light source arranged within the panel for illuminating the packaged beverage arranged on the panel, and an end cap comprising a front wall arranged at the front end of the panel.

In any of the various embodiments discussed herein, the end cap may further include a flange extending from the front wall of the end cap such that the flange is parallel to the panel. In some embodiments, the flange may include a plurality of cutouts.

In any of the various embodiments discussed herein, the panel may include a baseplate and a top plate, wherein the top plate defines the top surface.

In any of the various embodiments discussed herein, the light source may include a light guide.

In any of the various embodiments discussed herein, the light source may include a plurality of light emitting diodes.

In any of the various embodiments discussed herein, the display device may further include a power connector configured to place the display device in electrical connection with a power source. In some embodiments, the power connector may include a spring-biased probe.

Some embodiments described herein relate to display cabinet for displaying a packaged beverage that includes a housing defining a storage compartment configured to store the packaged beverage, wherein the storage compartment includes a first side opposite a second side and a front end opposite a rear end. The display cabinet may further include a shelf arranged within the storage compartment and extending between the first side and the second side, and a display device extending along the shelf at the front end of the storage compartment between the first side and the second side. The display device of the display cabinet includes a panel configured to support the packaged beverage having a front end opposite a rear end, a top surface having a plurality of transparent portions, and a light source for illuminating the packaged beverage arranged within the panel.

In any of the various embodiments discussed herein, the display device may further include an end cap having a front wall arranged at the front end of the panel.

In any of the various embodiments discussed herein, the end cap may further include a flange having a plurality of cutouts, wherein the flange extends from the front wall of the end cap such that the flange is parallel to the panel.

In any of the various embodiments discussed herein, the shelf may include a channel in which the display device is arranged.

In any of the various embodiments discussed herein, the display cabinet may further include a power bar arranged along a wall of the storage compartment at a front end of the storage compartment, wherein the power bar is configured to provide electrical energy to the display device.

In any of the various embodiments discussed herein, the display device may further include a power connector configured to contact the power bar to place the display device in electrical connection with the power bar when the display device is installed within the storage compartment.

BRIEF DESCRIPTION OF THE DRAWINGS/FIGURES

The accompanying drawings, which are incorporated herein and form a part of the specification, illustrate the present disclosure and, together with the description, further serve to explain the principles thereof and to enable a person skilled in the pertinent art to make and use the same.

DETAILED DESCRIPTION

Reference will now be made in detail to representative embodiments illustrated in the accompanying drawings. It should be understood that the following descriptions are not intended to limit the embodiments to one preferred embodiment. To the contrary, it is intended to cover alternatives, modifications, and equivalents as can be included within the spirit and scope of the described embodiments as defined by the claims.

Display cabinets for displaying packaged beverages may do little to highlight the products available for purchase or to attract the attention of consumers. While some display cabinets may include lighting to attract customers, the lighting may be decorative or may illuminate the interior of the display cabinet rather than highlighting the products available for purchase. As a result, display cabinets may not direct a consumer's attention to the products or entice the consumer to purchase the products.

Accordingly, an improved display device for attracting the attention of consumers is desired. Further, a display device that illuminates the products rather than the surrounding area is desired to focus the consumer's attention on the products available for purchase.

Some embodiments described herein relate to a display device having a light source on which a packaged beverage, such as a bottled beverage, may be placed for display. By placing the packaged beverage on the display device, the light source of the display device may illuminate the beverage within the bottle, providing a unique visual effect that may help to attract consumers. Some embodiments described herein may relate to system of multiple display devices in communication with a control unit for selectively illuminating the display devices. This may allow for display devices to illuminate packaged beverages in a sequence or pattern to help attract the attention of consumers.

Figure 1:
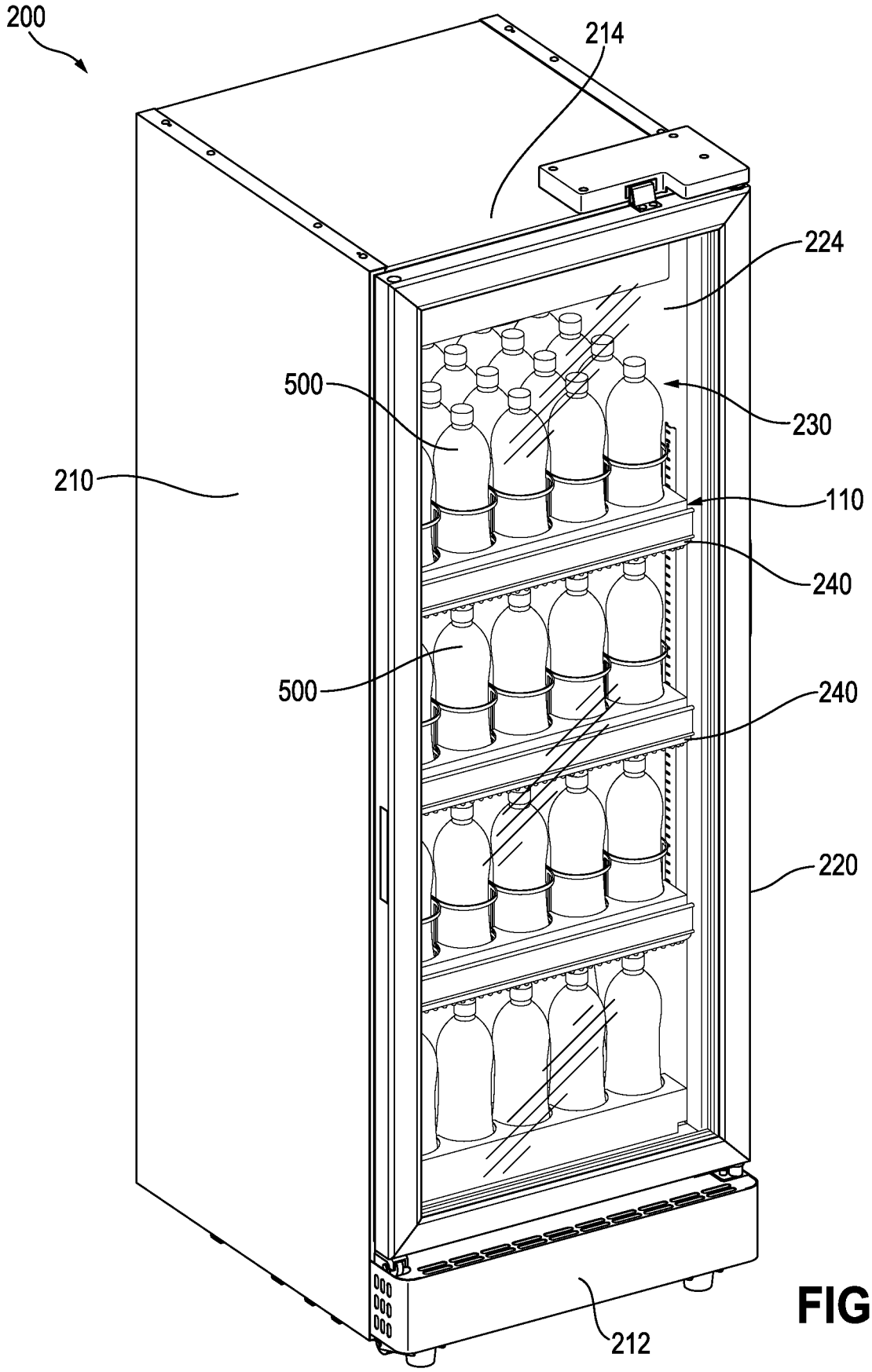
FIG. 1 shows a perspective view of a display cabinet having a display device for illuminating a packaged beverage according to an embodiment.

In some embodiments, a display device 110 may be arranged in a display cabinet 200 for illuminating a product stored in display cabinet 200, as shown in FIG. 1. Display cabinet 200 may include a housing 210 that defines a storage compartment 230 for storing and displaying products. Display cabinet 200 further includes a door 220 movably connected to housing 210 to provide access to storage compartment 230. In some embodiments, door 220 may be connected to housing 210 via hinges or by sliding on a track. Door 220 may include a transparent portion 224 so that packaged beverages 500 in storage compartment 230 are visible from an exterior of display cabinet 200. Storage compartment 230 may include one or more shelves 240 for supporting products, such as packaged beverages, in an upright or standing orientation. Products may be arranged in one or more rows on shelves 240. Shelves 240 may be vertically spaced from one another between lower end 212 and upper end 214 of housing 210.

In some embodiments, display cabinet 200 may be a cooler for maintaining products at a cool temperature or for storing perishable products. In such embodiments, display cabinet 200 may include a cooling unit for maintaining the storage compartment 230 at a predetermined temperature. Cooling unit may be a cold plate, a vapor-compression refrigeration unit, or a thermoelectric cooling unit, among others. Storage compartment 230 may be insulated to inhibit heat transfer into storage compartment 230. However, in some embodiments, storage compartment 230 may be maintained at ambient temperature.

A display device 110 may be arranged in display cabinet 200 for illuminating packaged beverages 500 within display cabinet 200. As used herein, the term "packaged beverage" may refer to a beverage container that contains a beverage, such as a bottled beverage, e.g., water, soda, sports drink, or coffee- or tea-based beverage, among others.

While the present application may refer primarily to a display device 110 for displaying packaged beverages, display device 110 and display cabinets may be used to display any of various products or merchandise, including but not limited to food items and cosmetic and beauty products, among other merchandise. Display device 110 may also be used with products having that have a clear or light-colored liquid contained in a transparent or translucent packaging, such as perfume or cologne, liquid soap or shampoo, and oils, among others. Display devices 110 described herein may be particularly suited for use in illuminating a product having a container that is transparent or partially transparent, i.e., translucent, so that light may pass through the container.

For example, the container may be formed of glass or plastic, among other transparent or partially transparent materials. Further, the liquid stored within the container may be a transparent or partially transparent so that light may pass through and refract within the liquid. For example, the liquid may be water, sparkling water, flavored water, light-colored sodas, such as a lemon-lime soda, or a sports drink, among others. While display device 110 may be used with dark-colored liquids, the lighting effect may not be as great as the light may not pass through the dark-colored liquid or may pass through only to a limited extent.

Figure 2A:
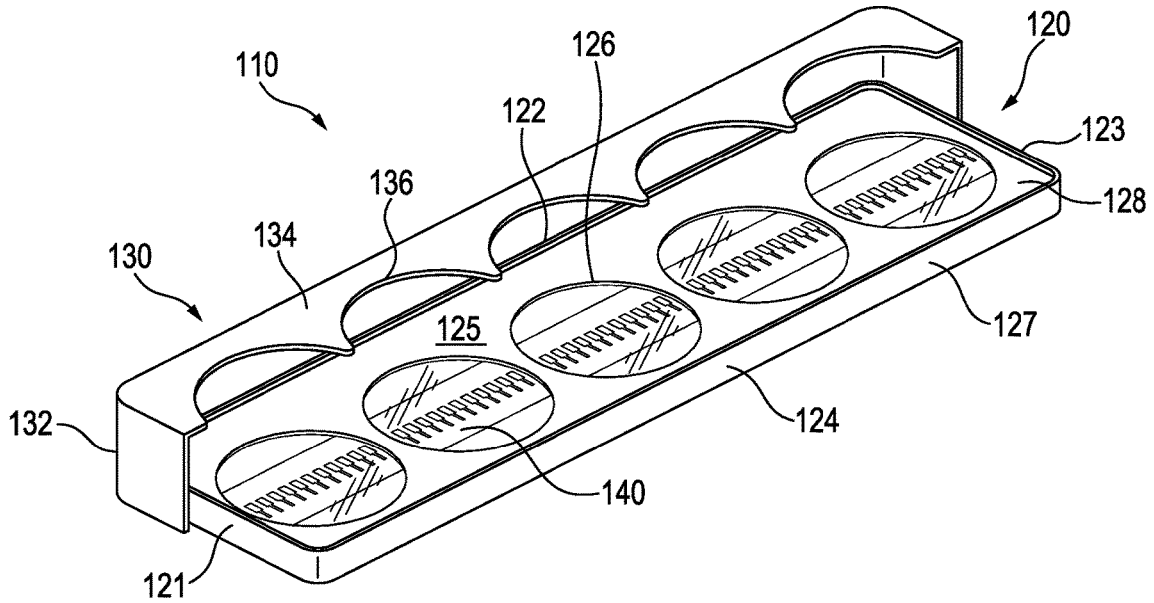
FIG. 2A shows a perspective view of a display device according to an embodiment.
Figure 2B:
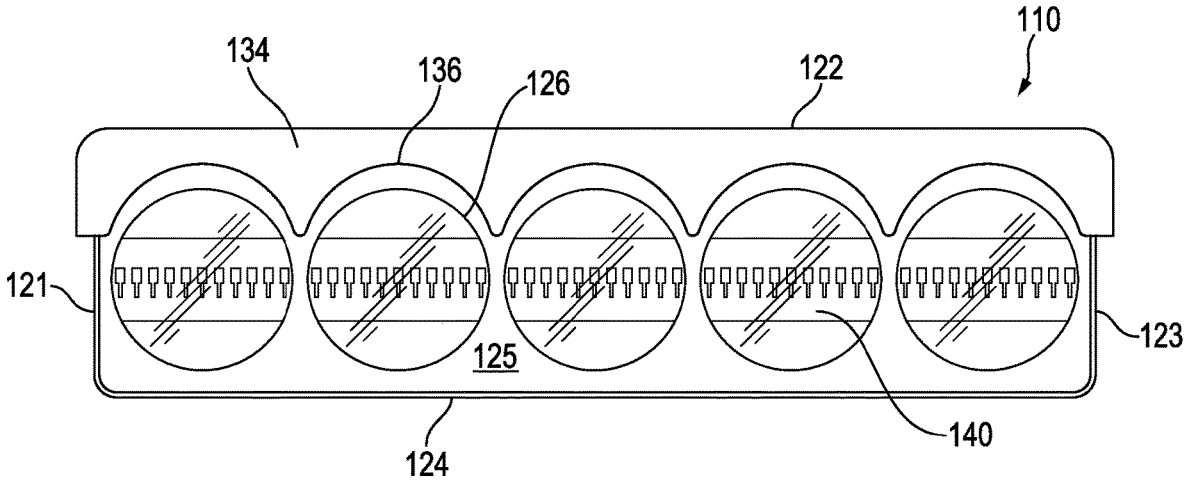
FIG. 2B shows a top down view of the display device of FIG. 2A.

In some embodiments, a display device 110 may include a panel 120 having a light source 140, as shown in FIGS. 2A and 2B. Panel 120 of display device 110 may have a generally rectangular configuration, as best shown in FIG. 2B. Panel 120 may include a front end 122 opposite a rear end 124 and a first side 121 opposite a second side 123. Panel 120 may include a baseplate 127 and a top plate 128 having a top surface 125. A packaged beverage may be arranged on panel 120 so that light source 140 is disposed beneath the packaged beverage. In some embodiments, top plate 128 may be removably secured to baseplate 127. However, in some embodiments, baseplate 127 and top plate 128 may be integrally formed so that panel 120 has a one-piece, unitary construction.

Light source 140 may be located on or within panel 120, such as between baseplate 127 and top plate 128. Light source 140 may illuminate packaged beverages placed on top plate 128, and may include openings, transparent portions, or both. In some embodiments, top plate 128 may include one or more transparent portions 126 configured to allow light from light source 140 to shine through transparent portions 126 of top plate 128. Transparent portions 126 may have a circular shape, however, in some embodiments, transparent portions may be square, triangular, elliptical, or may have other geometries. Transparent portions 126 may be made of glass, or a transparent plastic, such as polycarbonate, among other transparent materials. A lower end of a packaged beverage may be located on transparent portion 126 of top plate 128 so that packaged beverage is directly above light source 140. In this way, light may be directed from light source 140 into packaged beverage to illuminate the beverage and container, providing a "glowing" effect. The packaged beverage may be arranged in an upright or standing orientation on panel 120.

In some embodiments, light source 140 may be a plurality of light emitting diodes (LEDs), a light guide, a light pipe, or fiber optics, among others. For example, light source 140 may include a linear strip of a plurality of LEDs, or may include circular patterns or LEDs configured to be arranged beneath transparent portions 126 of panel 120. Light source 140 may be configured to provide light that is white or colorless. In this way, a packaged beverage will illuminate in a color based on a color of the beverage. However, in some embodiments, light source 140 may be colored so as to illuminate a beverage within a beverage container in a particular color. For example, when the beverage is water, a green light source may illuminate the beverage so as to illuminate the packaged beverage in a green color. In some embodiments, a coating may be applied on light source 140, such as a hydrophobic coating, to protect light source 140 from moisture.

Light source 140 may extend along panel 120 from a first side 121 toward a second side 123. Light source 140 may include portions that can be illuminated separately from one another. For example, light source 140 may include a plurality of LEDs arranged on panel 120 and extending from the first side 121 toward second side 123, and LEDs on first side 121 may be illuminated while LEDs on second side 123 are not be illuminated.

Figure 3:
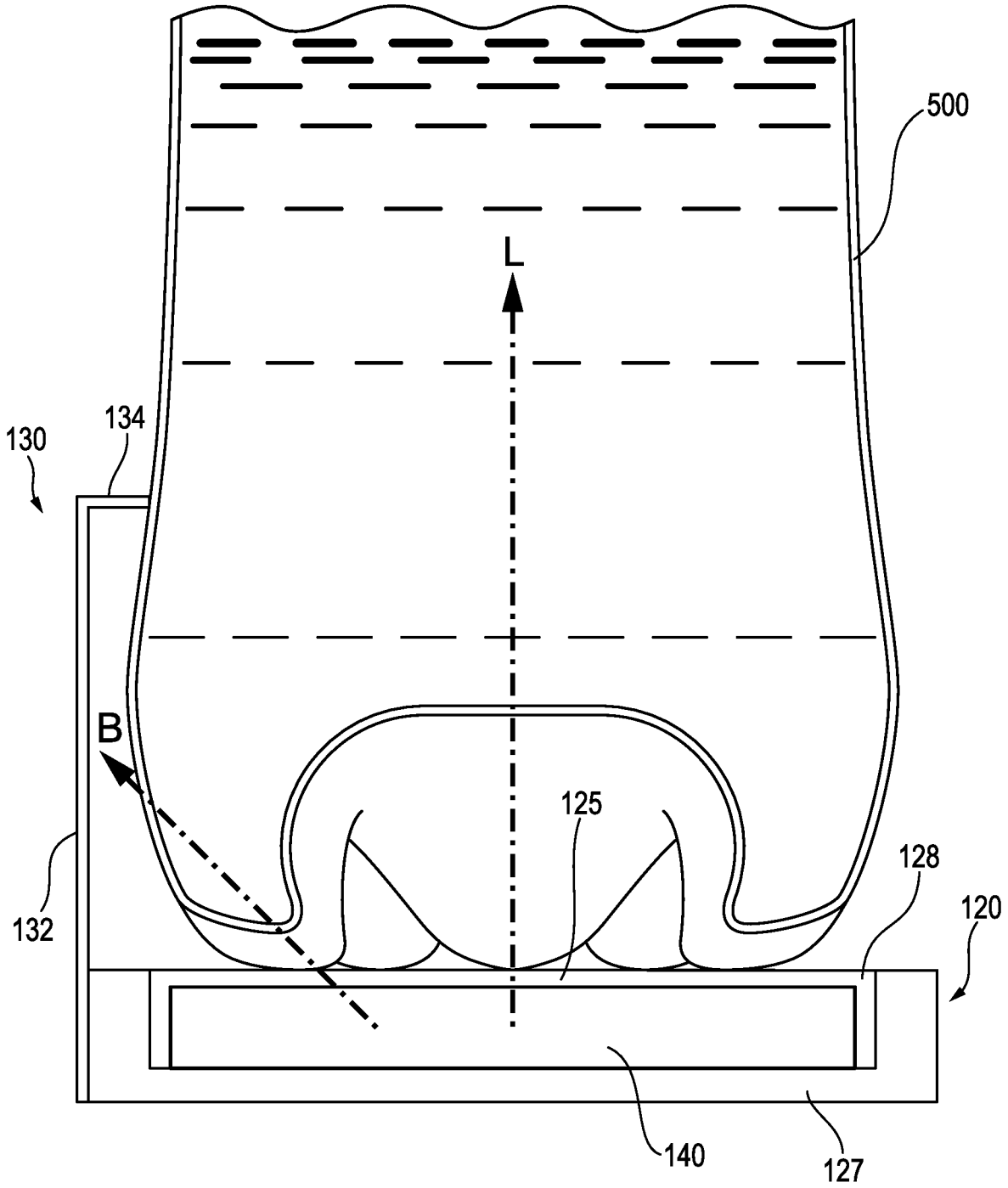
FIG. 3 shows a side view of a display device according to an embodiment with a packaged beverage thereon.

In some embodiments, an end cap 130 may be arranged along front end 122 of panel 120. End cap 130 may block light B produced by light source 140 so that light is not directed outward from front end 122 of panel 120 (see, e.g., FIG. 3). This helps to prevent light B from shining toward consumer, which may be distracting. End cap 130 may further extend at least partially along first and second sides 121, 131 of panel 120, as shown in FIG. 2A. End cap 130 may include a front wall 132 that extends upward from panel 120 and may be perpendicular to panel 120. End cap 130 may further include a flange 134 extending from an upper end of front wall 132 perpendicular to front wall 132 and parallel to panel 120 in a direction toward rear end 124 of panel 120. Flange 134 may help to support and position packaged beverages 500. In some embodiments, flange 134 may have cutouts 136 configured to contour to a shape of a sidewall of a packaged beverage 500. In some embodiments, cutouts 136 may have a concave shape, and may be shaped as a portion of a circle so as to surround a sidewall of a packaged beverage having a circular transverse cross sectional area (e.g., a bottle). Cutouts 136 may be aligned with transparent portions 126 of panel 120 so that a packaged beverage 500 arranged on a transparent portion 126 of panel 120 may also be arranged within cutout 136 of flange 134 so that flange 134 may further support packaged beverage 500.

Figure 4:
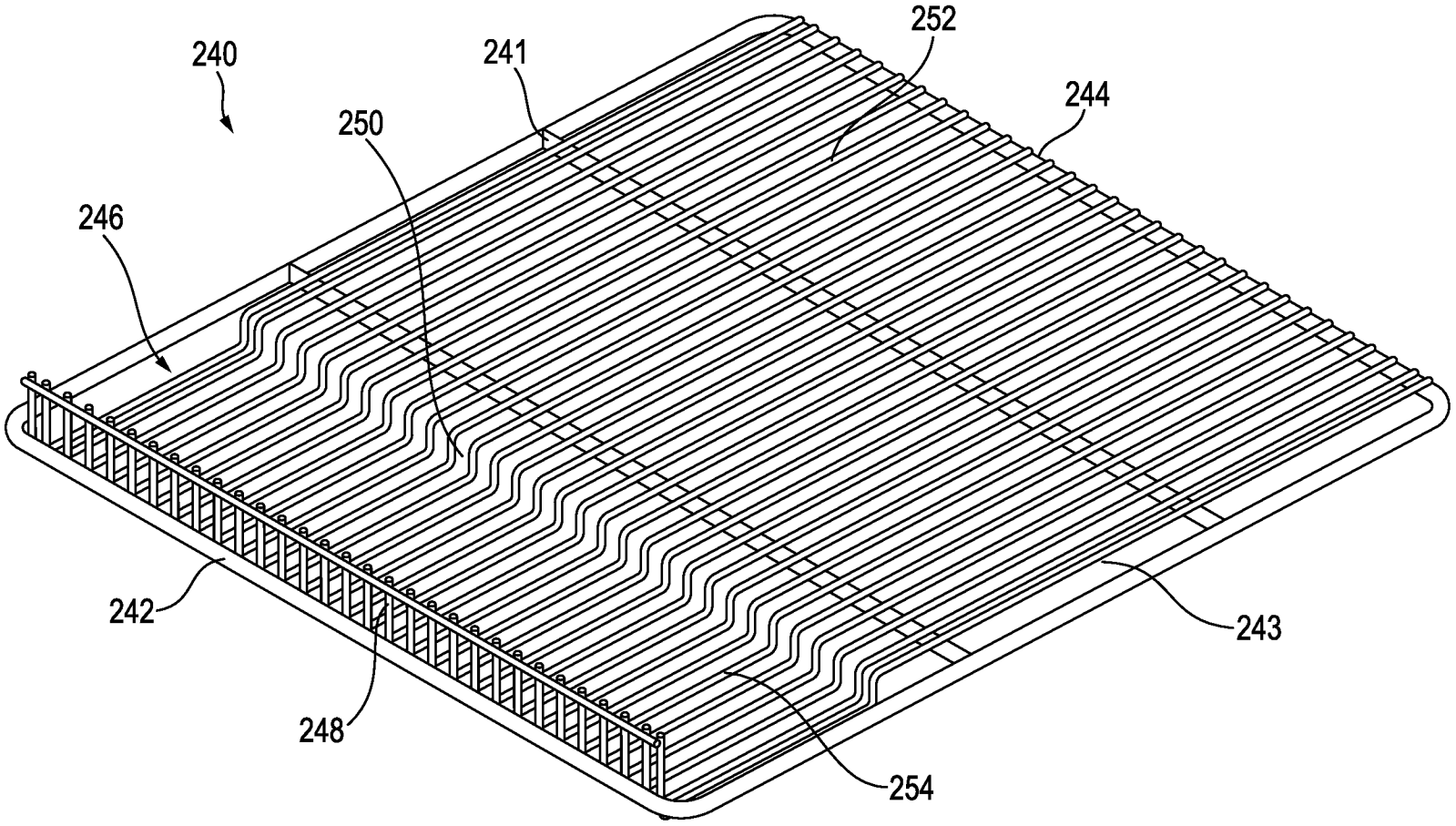
FIG. 4 shows a perspective view of a shelf for supporting a display device and packaged beverages according to an embodiment.
Figure 5:
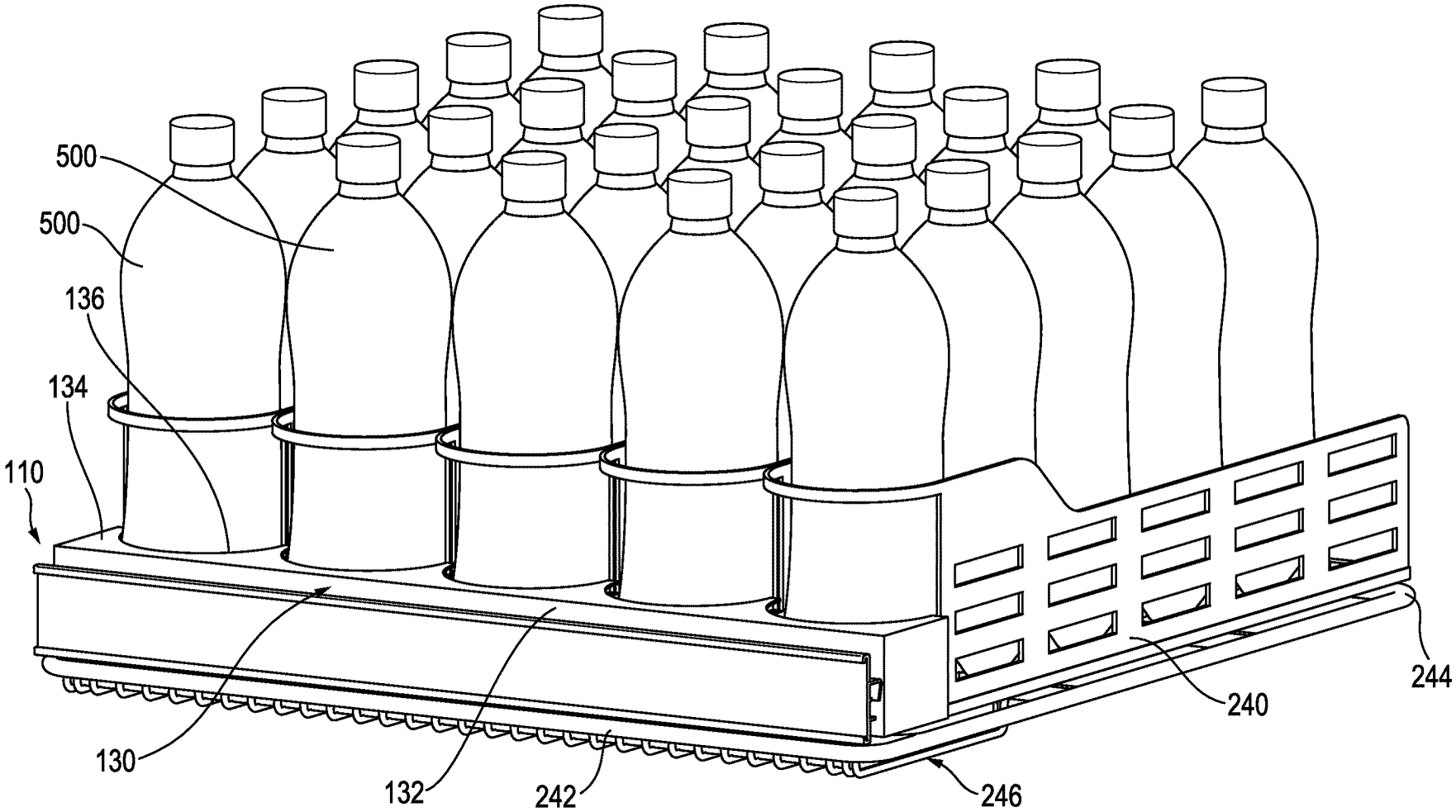
FIG. 5 shows a perspective view of a display device and packaged beverages arranged on a shelf according to an embodiment.

In some embodiments, display device 110 may be arranged on a shelf 240, as shown in FIGS. 4 and 5. Shelf 240 may include a front end 242 opposite a rear end 244 and a first side 241 opposite a second side 243, as shown in FIG. 4. Display device 110 may be arranged at least at front end 242 of shelf 240 so that a front row or first row of packaged beverages arranged on shelf 240 may be illuminated by display device 110 (see, e.g., FIG. 5). Display device 110 may extend between first and second sides 241, 243 of shelf 240 and may extend from first side 241 to second side 243.

In some embodiments, shelf 240 may include a first region 252 and a second region 254, as shown in FIG. 4. Second region 254 may be arranged in a plane that is parallel to and spaced below a plane of the first region 252. First region 252 and second region 254 may be connected by an upright region 250 that is perpendicular to both first and second regions 252, 254 so that shelf 240 has a stepped configuration. Second region 254 may be arranged toward front end 242 of shelf 240, and may be configured to support display device 110. Shelf 240 may further include an upright wall 248 at front end 242 of shelf 240. Upright wall 248 may extend perpendicularly from second region 254 of shelf 240. In this way, shelf 240 defines a channel 246 at second region 254 bounded by upright wall 248 and upright region 250 so that display device 110 may be arranged on second region 254 and is maintained in position within channel 246. However, in some embodiments, shelf 240 may be planar in configuration.

As shown in FIG. 5, display device 110 may be placed on top of a front end 242 of shelf 240 and extend between opposing sides of shelf 240. Display device 110 may be arranged within channel 246 of shelf 240. Panel 120 of display device 110 may have a height that is the same as a height of upright region 250 of shelf 240 so that packaged beverages 500 arranged on panel 120 of display device 110 are at the same height as packaged beverages 500 arranged on first region 252 of shelf 240. Front wall 132 of end cap 130 of display device 110 may block light from light source 140, and flange 134 of end cap 130 may help to support packaged beverages 500 in position.

In some embodiments, display device 110 may be configured to support a single row of packaged beverages 500, as shown in FIG. 5. In such embodiments, display device 110 may be arranged at front end 242 of shelf 240 so that only a front row of packaged beverages 500 is illuminated by display device 110. However, in some embodiments, display device 110 may be configured to illuminate multiple rows of packaged beverages 500. Panel 120 of display device 110 may have a greater width to accommodate the additional rows of packaged beverages, wherein width is measured in a direction from the front end 122 to the rear end 124 of panel 120. In some embodiments, panel 120 may have a square shape. In some embodiments, panel 120 may fully cover the shelf 240 on which display device 110 is arranged. In this way, display device 110 may be configured to illuminate all packaged beverages on a shelf 240.

In some embodiments, display device 110 may be integrally formed with shelf 240. In some embodiments, display device 110 may be arranged underneath shelf 240. Display device 110 may be secured to an underside of shelf 240, or to opposing walls of a storage compartment of a display cabinet. In such embodiments, shelf 240 may be formed of a transparent material, or may have openings so that light from display device 110 may pass through shelf 240 and illuminate a packaged beverage positioned on shelf 240.

Figure 6:
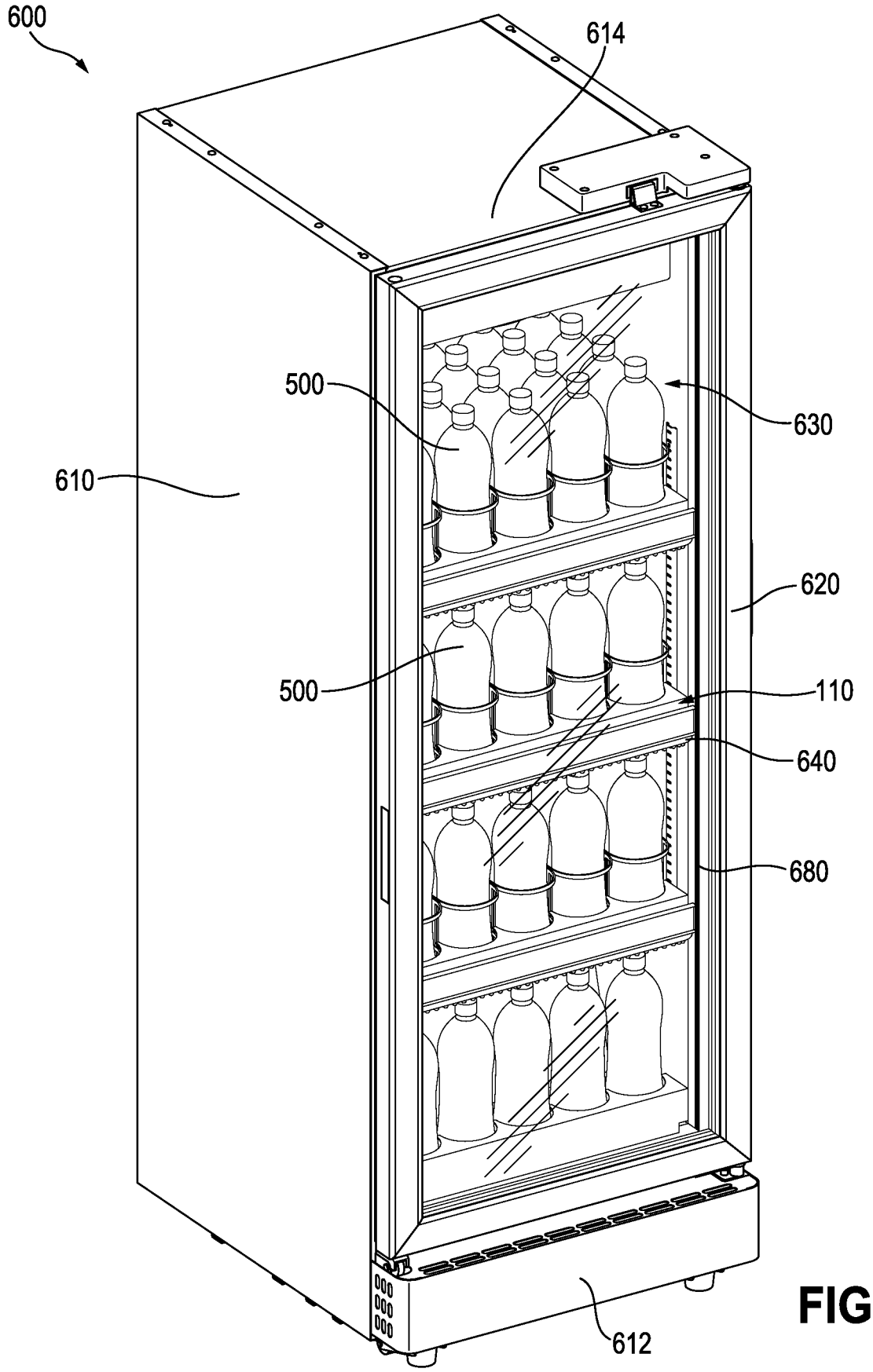
FIG. 6 shows a perspective view of a display cabinet having a power bar for providing electrical energy to a display device according to an embodiment.
Figure 7:
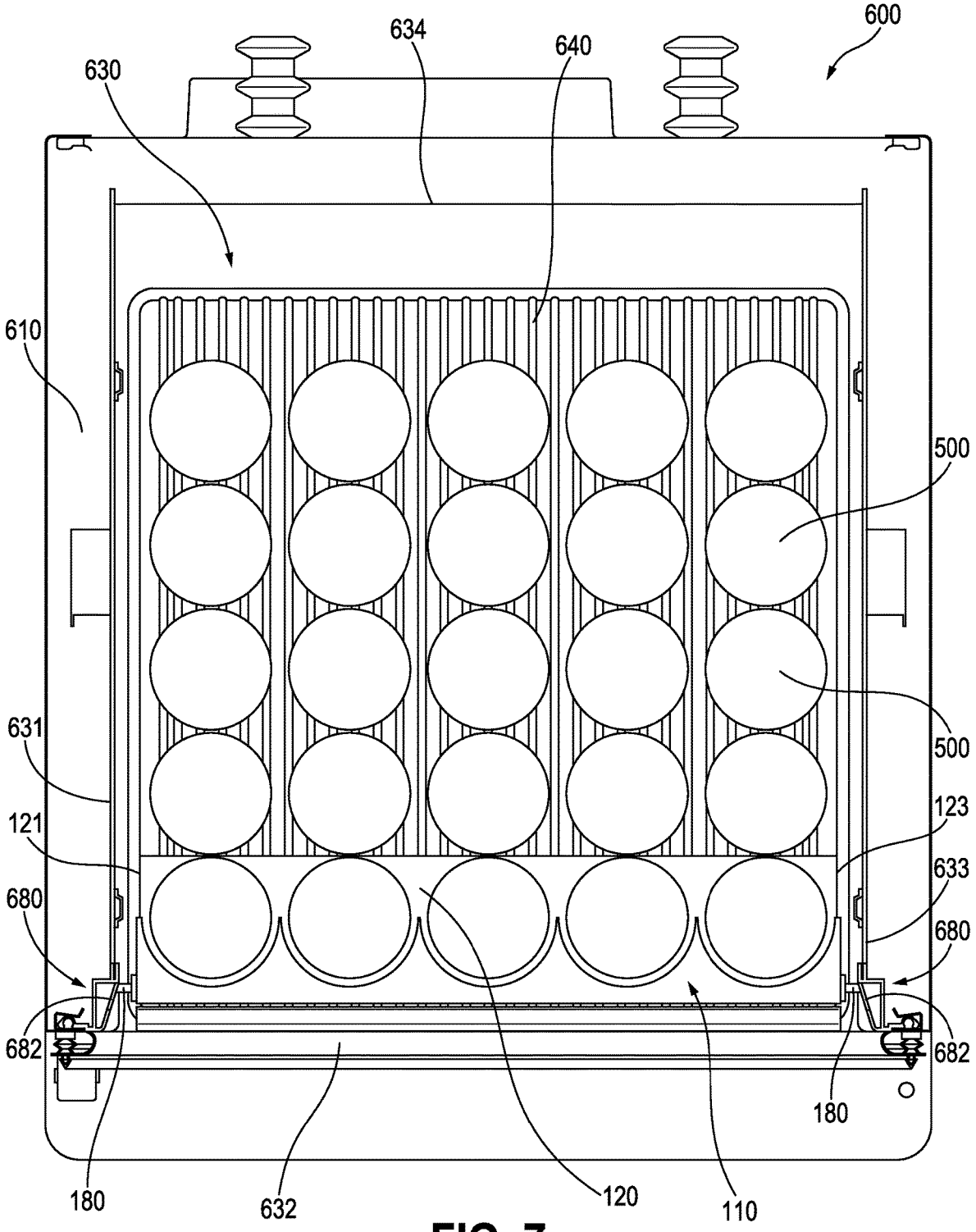
FIG. 7 shows a top down view of a display device connected to a power bar of the display cabinet according to an embodiment.

In some embodiments, a display cabinet 600 may include a power bar 680 configured to supply power to display devices 110 within display cabinet 600, as shown in FIG. 6. Display cabinet 600 may be similar to display cabinet 200 described above, and may include a housing 610 defining a storage compartment 630 for holding packaged beverages 500. One or more shelves 640 may be arranged within storage compartment 630 for supporting display devices 110 and packaged beverages 500. Storage compartment 630 may include a front end 632 opposite a rear end 634 and a first side 631 opposite a second side 633 (e.g., left side and right side), as best shown in FIG. 7. Display cabinet 600 may further include a door 620 movably secured to housing 610 for providing access to storage compartment 630.

However, display cabinet 600 differs from display cabinet 200 in that display cabinet 600 includes a power bar 680 for providing electrical energy to display device 110. Power bar 680 may be made of a conductive material, such as a metal, e.g., copper. As best shown in FIG. 6, power bar 680 may extend along a wall of storage compartment 630 in a direction from lower end 612 toward upper end 614 of display cabinet 600. In some embodiments, a first power bar 680 may extend along a first side 631 of storage compartment 630, and a second power bar 680 may extend along a second side 633 of storage compartment 630, as shown in FIG. 7. Power bars 680 may be arranged on first and second sides 631, 633 of storage compartment 630 near front end 632 of storage compartment 630. First and second power bars 680 may serve as positive and negative terminals for connection to display device 110.

In some embodiments, display device 110 may further include a power connector 180 for connection to a power source to supply electrical energy to display device 110 and particularly to the light source of display device 110. In some embodiments, display device 110 may include a power connector 180 on a first side 121 of panel 120 and a second power connector 180 on an opposing second side 123 of panel 120, as shown in FIG. 7. When display device 110 is arranged within storage compartment 630, first power connector 180 connects to first power bar 680 and second power connector 180 connects to second power bar 680. In this way, display cabinet 600 may provide electrical energy to power display device 110 inserted within display cabinet 600 when power connectors 180 are connected to power bars 680 of display cabinet 600.

Power connectors 180 may be linearly movable from an extended to a compressed configuration. Power connectors 180 may be biased in an extended configuration and may be configured to compress when an inward force is applied to the power connectors 180 along an axis of power connector 180. In some embodiments, power connectors 180 may be spring-biased probes. However, alternate biasing mechanisms may be used.

Figure 8B:
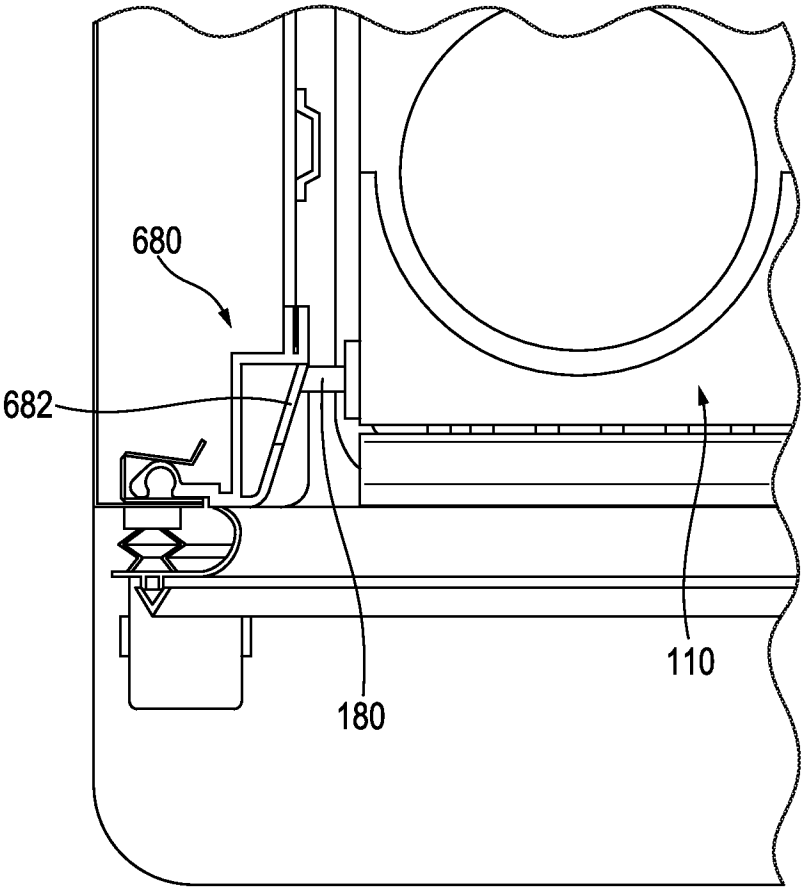
FIG. 8B shows a close-up view of a power connector of a display device inserted into the display cabinet and connected to a power bar of the display cabinet according to an embodiment.
Figure 8A:
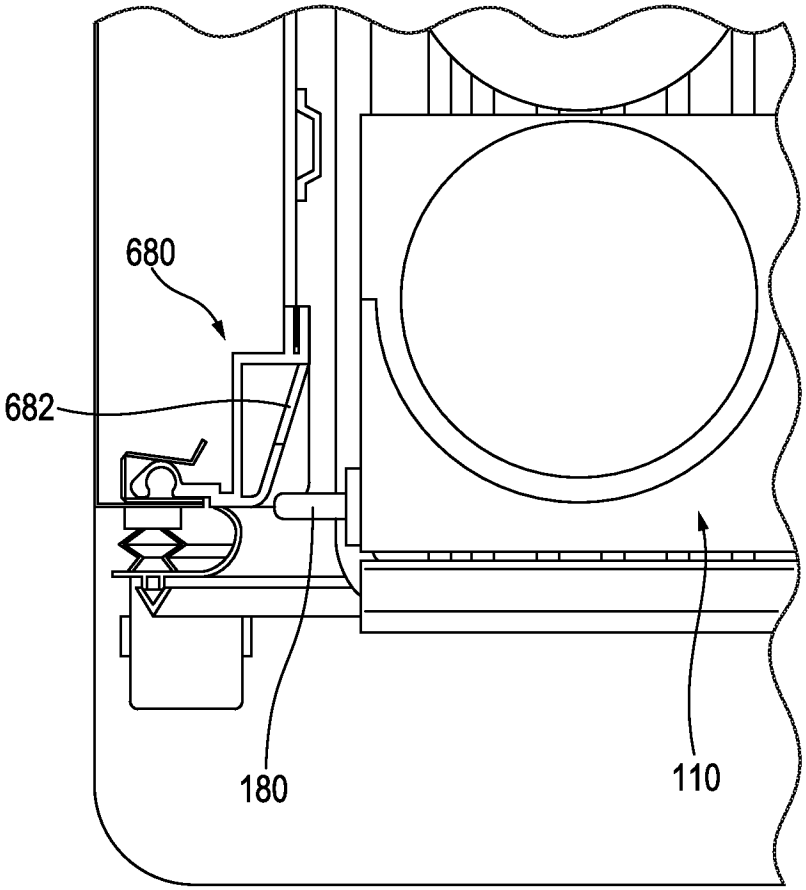
FIG. 8A shows a close-up view of a power connector of a display device positioned for insertion into a display cabinet according to an embodiment.

As shown in FIGS. 8A and 8B, display device 110 may be automatically connected to a power source when a shelf 640 having display device 110 is inserted into storage compartment 630 of display cabinet 600. Shelf 640 may be inserted into storage compartment 630 by moving shelf 640 in a direction from front end of storage compartment 630 to rear end of storage compartment 630. Display device 110 includes power connectors 180 in an extended configuration prior to placement of shelf 640 within storage compartment 630, as shown in FIG. 8A. As shelf 640 moves from front end toward rear end of storage compartment 630, power connectors 180 of display device 110 contact a contact plate 682 of power bars 680, such that contact plates 682 exert an inward force on power connectors 180. As a result, power connectors 180 are moved to a compressed configuration, as shown in FIG. 8B, and power connectors 180 are in contact with contact plates 682 of display cabinet 600. In this way, display device 110 can be connected to a source of electricity by installing shelf 640 in display cabinet 600, and no further actions are required to make an electrical connection, such as plugging a power cable into an electrical outlet.

In some embodiments, contact plate 682 of power bar 680 may be arranged at an angle relative to sidewall 631 or sidewall 633 of storage compartment 630. Particularly, contact plate 682 may have an inward angle. In this way, power connectors 180 may exert an inward pressure on power connectors 180 of display device 110 as display device 110 is inserted further into storage compartment 630, and power connector 180 is in connection with contact plate 682 when shelf 640 is installed in display cabinet 600.

Figure 9:
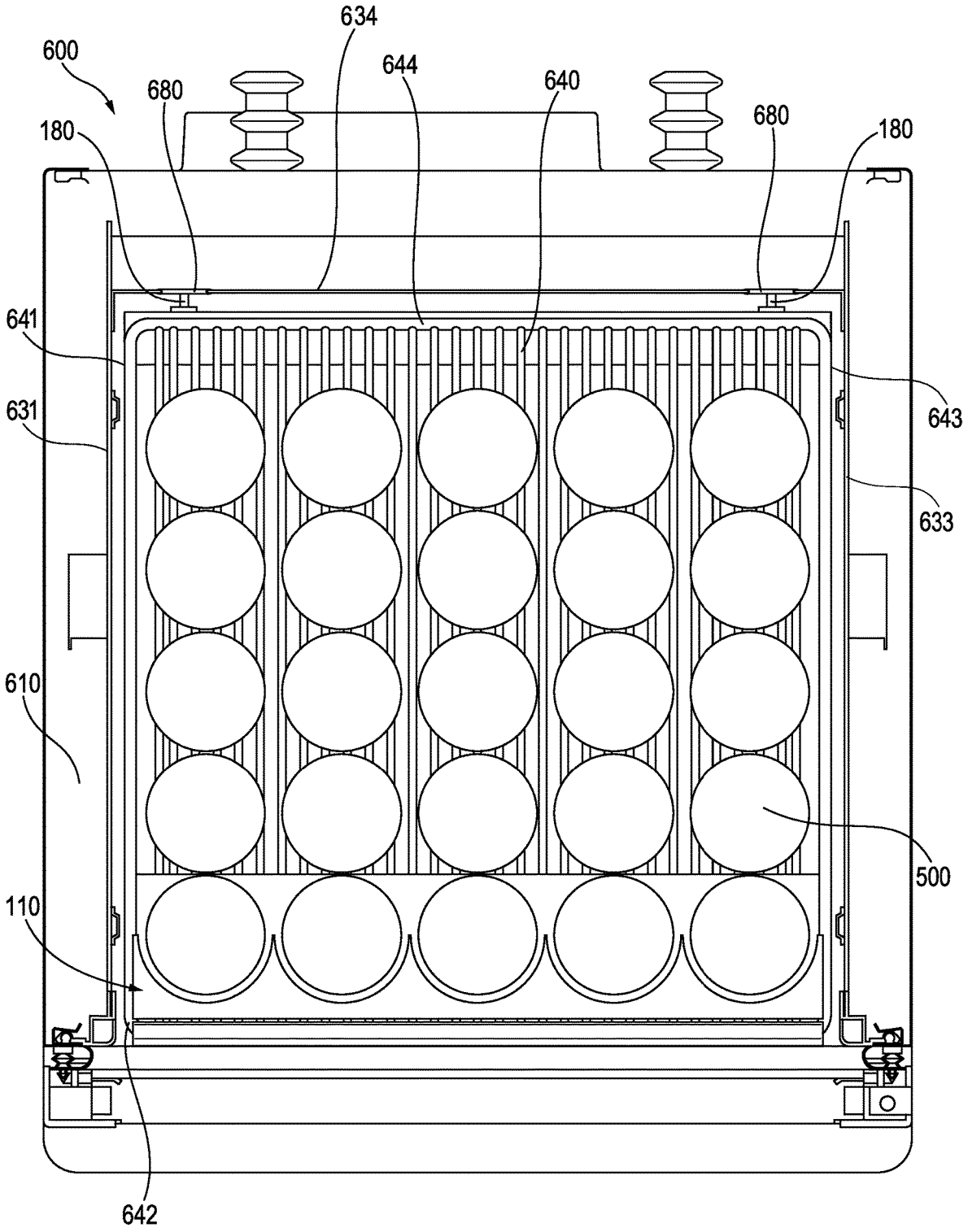
FIG. 9 shows a top down view of a display device connected to a power bar of the display cabinet according to an embodiment.

In some embodiments, as shown in FIG. 9, power connectors 180 as described above may instead be arranged on shelf 640 rather than on display device 110. Power connectors 180 may be electrically connected to display device 110 via one or more wires. Wires may extend along shelf 640, such as along an underside of shelf 640, or may be arranged within an interior of shelf 640. As discussed above, power connectors 180 may be movable between an extended and compressed configurations and may be biased in the extended configuration. In some embodiments, a first power connector 180 may be arranged on rear end 644 of shelf 640 toward a first side 641, and a second power connector 180 may be arranged on rear end 644 of shelf 640 toward second side 643. In this way, when shelf 640 is installed within display cabinet 600, first and second power connectors 180 may be electrically connected to power bars 680 located on a rear end 634 of storage compartment 630.

In some embodiments, a first power connector 180 may be arranged on first side 641 of shelf 640 toward rear end 644 of shelf 640, and a second power connector 180 may be arranged on the second side 643 of shelf 640 toward rear end 644 of shelf 640. In such embodiments, power bars 680 may be arranged on opposing first and second sides 631, 633 of storage compartment 630 adjacent rear end 634 for connection to power connectors 180.

In some embodiments, display device 110 may have its own power source. In such embodiments, display device 110 may have one or more batteries, such as disposable or rechargeable batteries. Power source may be stored within panel 120 of display device 110. In some embodiments, display device 110 may be configured to be connected to a power source, such as a power outlet via a power cable, or display device 100 may be connected to a power supply of a display cabinet 200 via a plug-in or connector. In some embodiments, display device 110 may be connected to a solar power source, such as one or more solar cells located on or remote from display device 110.

While some embodiments described herein relate to a display device 110 for use in a display cabinet 200, 600, display device 110 may be used in any of various settings. For example, display device 110 may be arranged on a countertop or tabletop, or may be arranged on another support structure or support surface.

Figure 10:
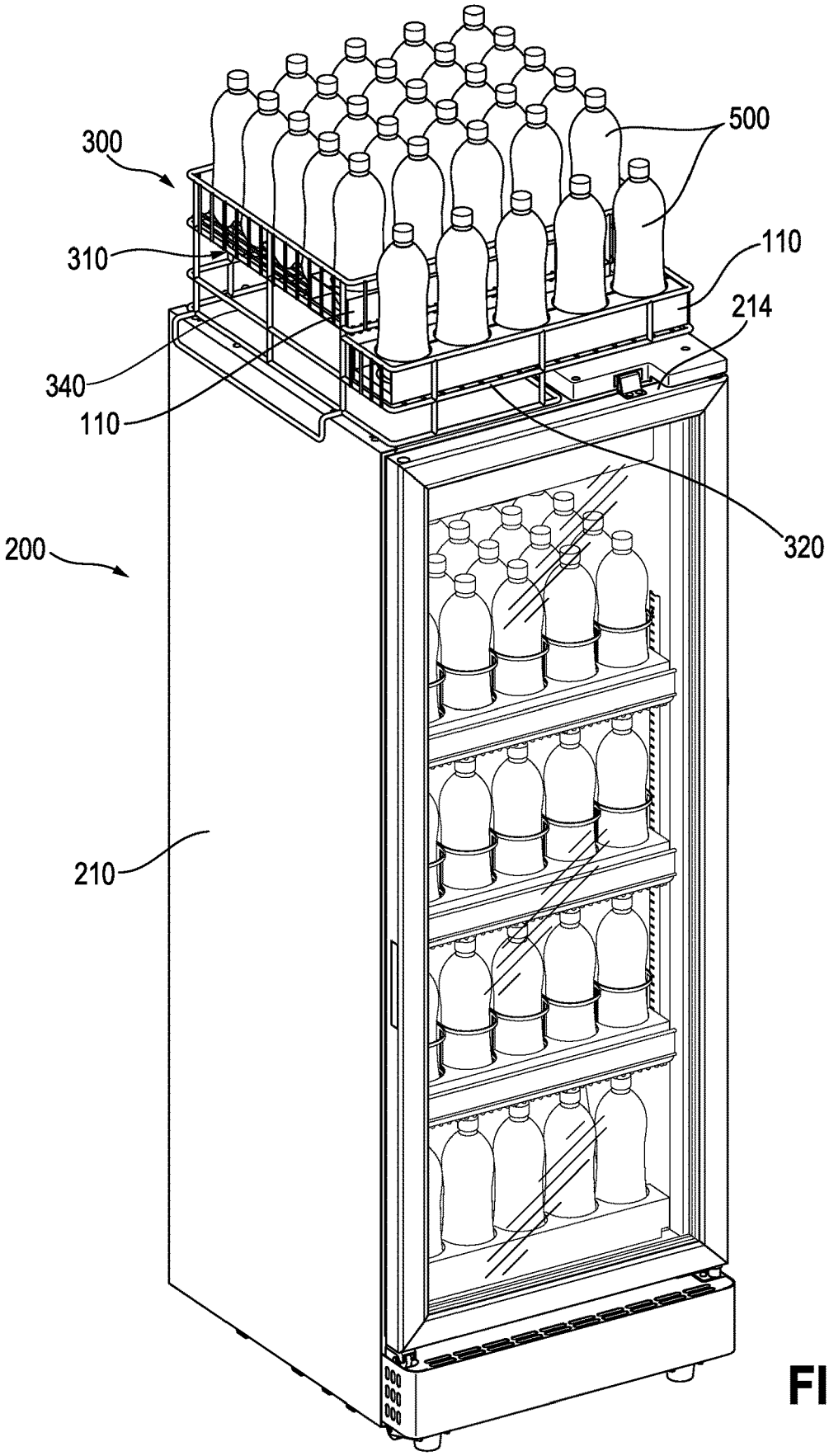
FIG. 10 shows a perspective view of a display rack configured to support a display device and packaged beverages according to an embodiment.

In some embodiments, a display device 110 may be arranged on a display rack 300, as shown in FIG. 10. Display rack 300 may include a frame 340 that supports a plurality of platforms 310, 320 at different elevations. Thus, display rack 300 may have a stepped configuration. Arranging platforms at different elevations may allow for packaged beverages 500 on each platform to be more easily viewed without obstruction by packaged beverages on other platforms. A display device 110 may be arranged on one or more of the platforms 310, 320 for illuminating packaged beverages 500 placed on each platform 310, 320. Display rack 300 may be arranged on a support structure, such as a countertop or a tabletop, and in some embodiments, display rack 300 may be arranged on an upper end 214 of a cabinet 200. In such embodiments, display device 110 may be configured to be placed in electrical communication with a power supply of a display cabinet 200, and display device 110 may include power connectors to engage with power bars as described above, wherein the power bars are arranged on a top surface of the display cabinet 200.

Figure 11:
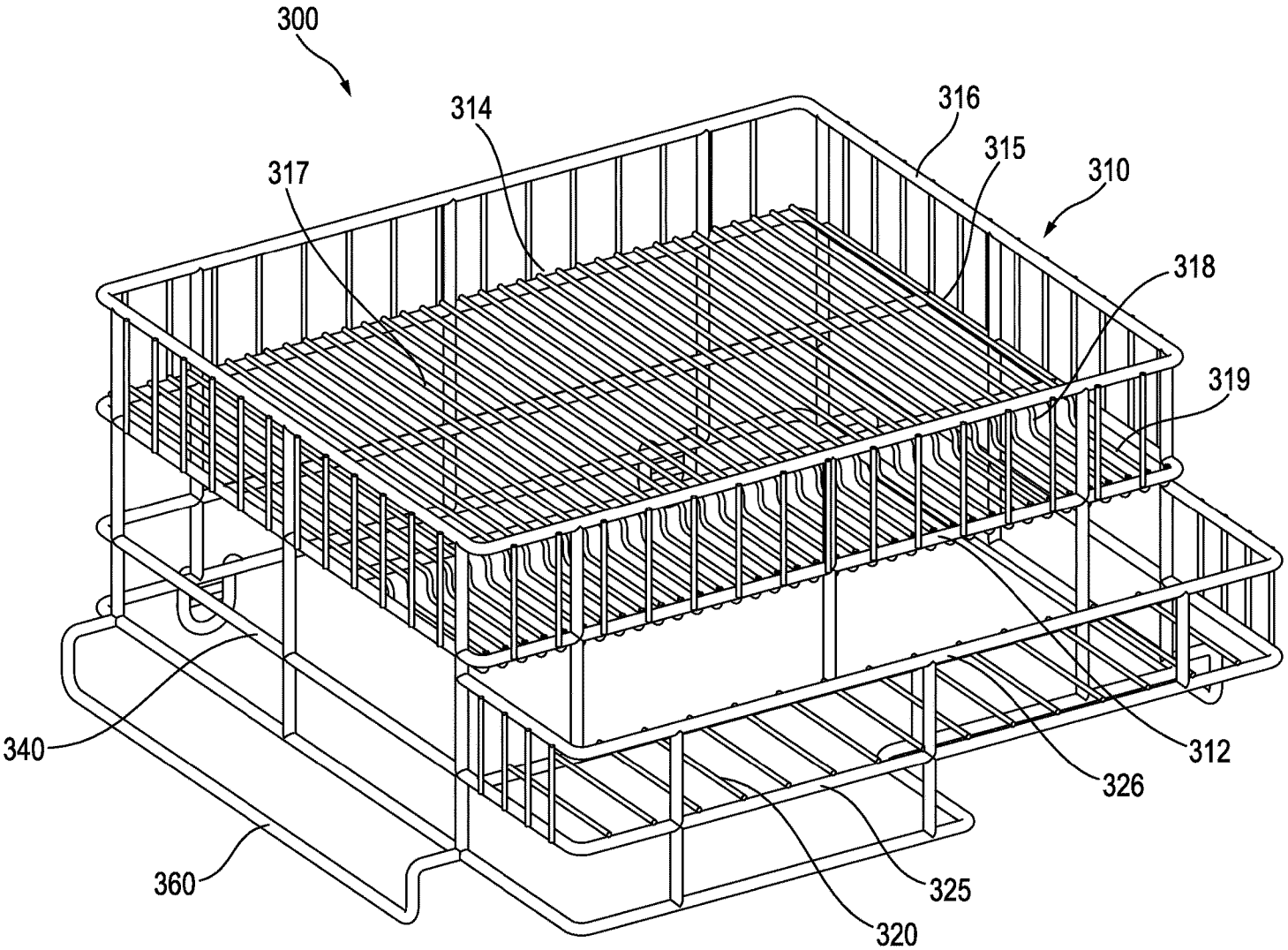
FIG. 11 shows a perspective view of a display rack according to an embodiment.

As shown in FIG. 11, display rack 300 may include a frame 340 supporting a plurality of platforms 310, 320. In the embodiment of FIG. 11, display rack 300 includes a first platform 310 and a second platform 320 arranged at different elevations. However, in alternate embodiments, display rack 300 may include fewer or additional platforms. Second platform 320 may be located at front end 312 of first platform 310 in front of first platform 310 and may be located on a plane that is parallel to and below a plane of first platform 310. In some embodiments, additional platforms may be similarly located in front of and below second platform 320, such as a third platform, and a fourth platform, etc.

Figure 12:
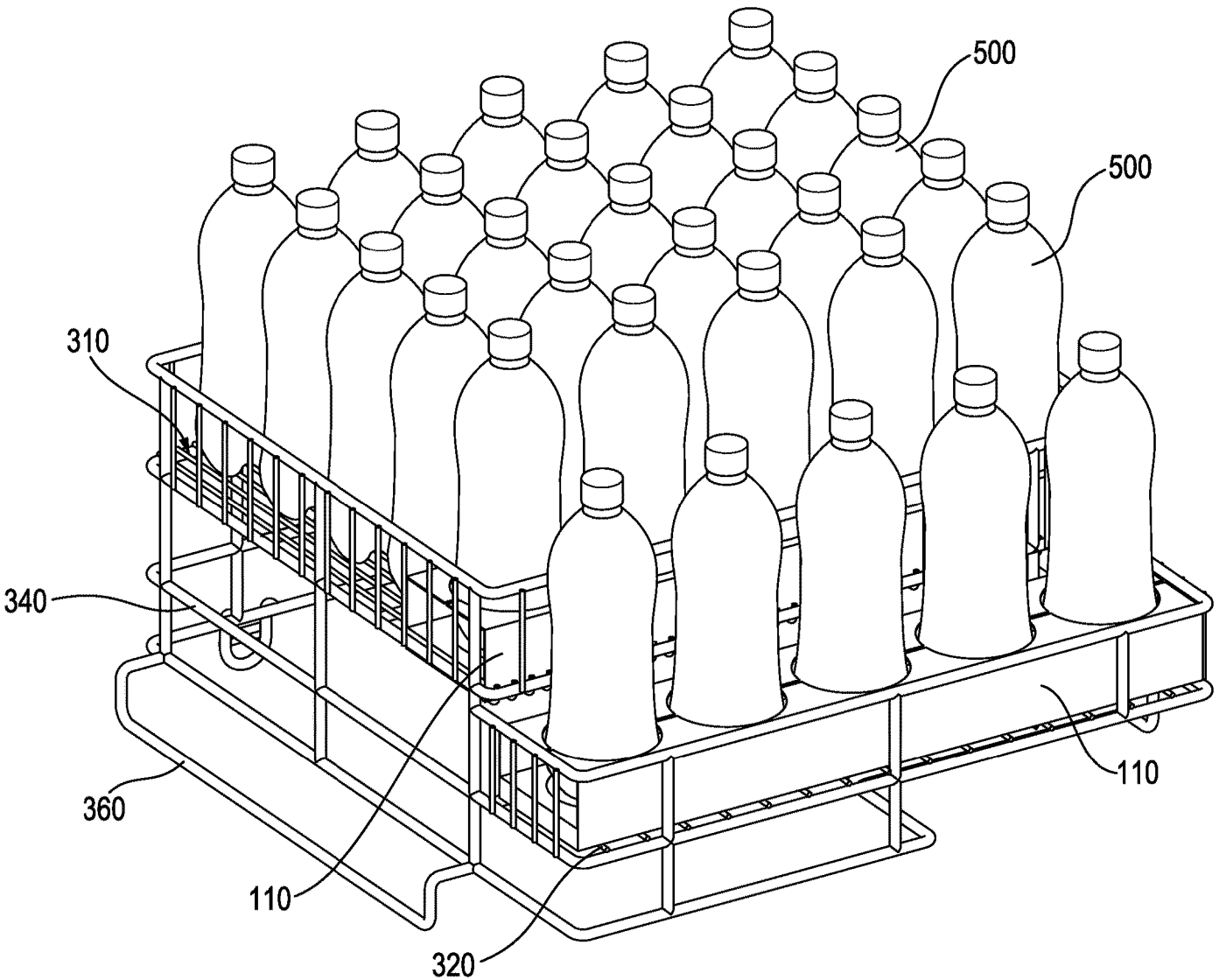
FIG. 12 shows a perspective view of a display rack having display devices and packaged beverages arranged thereon according to an embodiment.

First platform 310 may be the uppermost platform of display rack 300. First platform 310 may have a square configuration so as to support multiple rows of packaged beverages 500, as shown in FIG. 12. In some embodiments, first platform 310 may include a first region 317 and a second region 319, wherein the second region 319 is in a plane that is parallel to and below a plane of the first region 317. Second region 319 may be connected to first region by an upright region 318. Thus, first platform 310 may have a configuration that is similar to shelf 240, as shown in FIG. 4. Second platform 320, and any subsequent platforms may each have a rectangular configuration so that second platform 320 and subsequent platforms may support a single row of packaged beverages 500.

In some embodiments, frame 340 and platforms 310, 320 may be formed from wires or wire mesh. This may help to promote air circulation around packaged beverages arranged on display rack 300. For example, each platform 310 may include a plurality of spaced parallel wires connected and supported by crosspieces. However, in some embodiments, frame 340 and platforms 310, 320 may be formed from plastic, metal, or glass sheets or panels.

In some embodiments, an upstanding wall 316, 326 may extend along at least a portion of the perimeter 315, 325 of each platform 310, 320. As shown in FIG. 11, upstanding walls 316, 326 extend around an entire perimeter 315, 325 of each platform 310, 320. Upstanding wall 316, 326 is configured to help to maintain packaged beverages 500 in position on display rack 300, and to maintain position of display devices 110 on display rack 300. Upstanding walls 316, 326 may be perpendicular to each platform 310, 320.

While embodiments described herein primarily refer to a display rack 300 having platforms 310, 320 with a rectangular or square configuration, platforms may have alternate shapes. In some embodiments, for example, platforms may have a curvature, and may have an arced shape. Thus, display rack 300 may have an amphitheater shape. Further, platforms may have a serpentine or undulating shape to provide additional visual interest.

Figure 13:
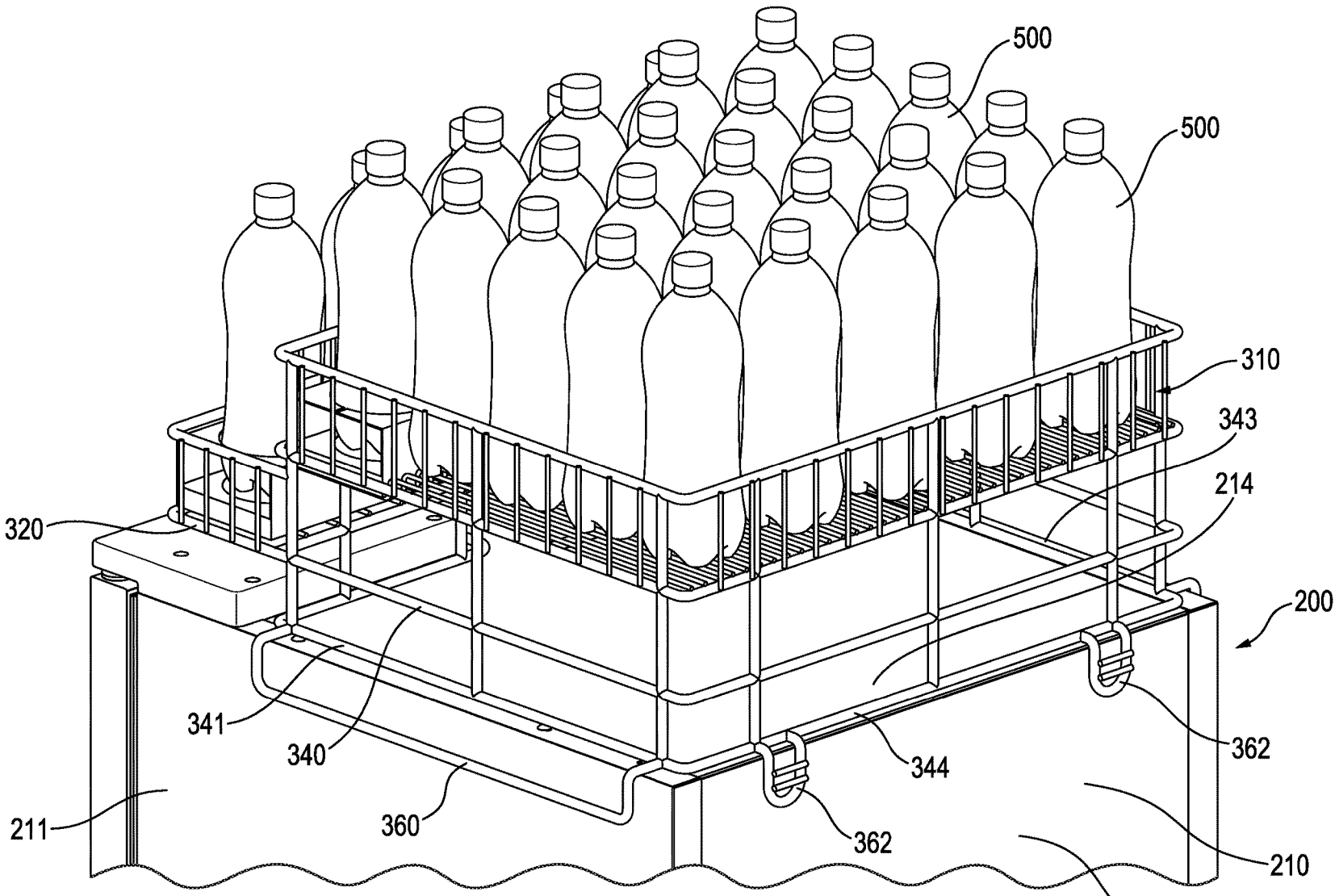
FIG. 13 shows a rear perspective view of a display rack arranged on an upper end of a display cabinet according to an embodiment.

In some embodiments, display rack 300 may include securement devices for securing display rack 300 to a support structure. In FIG. 13, display rack 300 is mounted on upper end 214 of a display cabinet 200. Frame 340 of display rack 300 may include a leg 360 on a first side 341 of frame 340 and a second leg on an opposing second side 343 of frame 340. Legs 360 may be configured to extend along a sidewall 211 of display cabinet 200 to prevent movement of display rack 300 on upper end 214 of display cabinet 200. In some embodiments, display rack 300 may alternatively or additionally include one or more stoppers 362 on a rear end 344 of frame 340. Stoppers 362 may be configured to contact a rear wall 217 of housing 210 of display cabinet 200 to restrict movement of display rack 300 toward front end of display cabinet 200. In some embodiments, legs 360 and stoppers 362 may exert an inward force on housing 210 of display cabinet 200 to hold display rack 300 in position.

Figure 14:
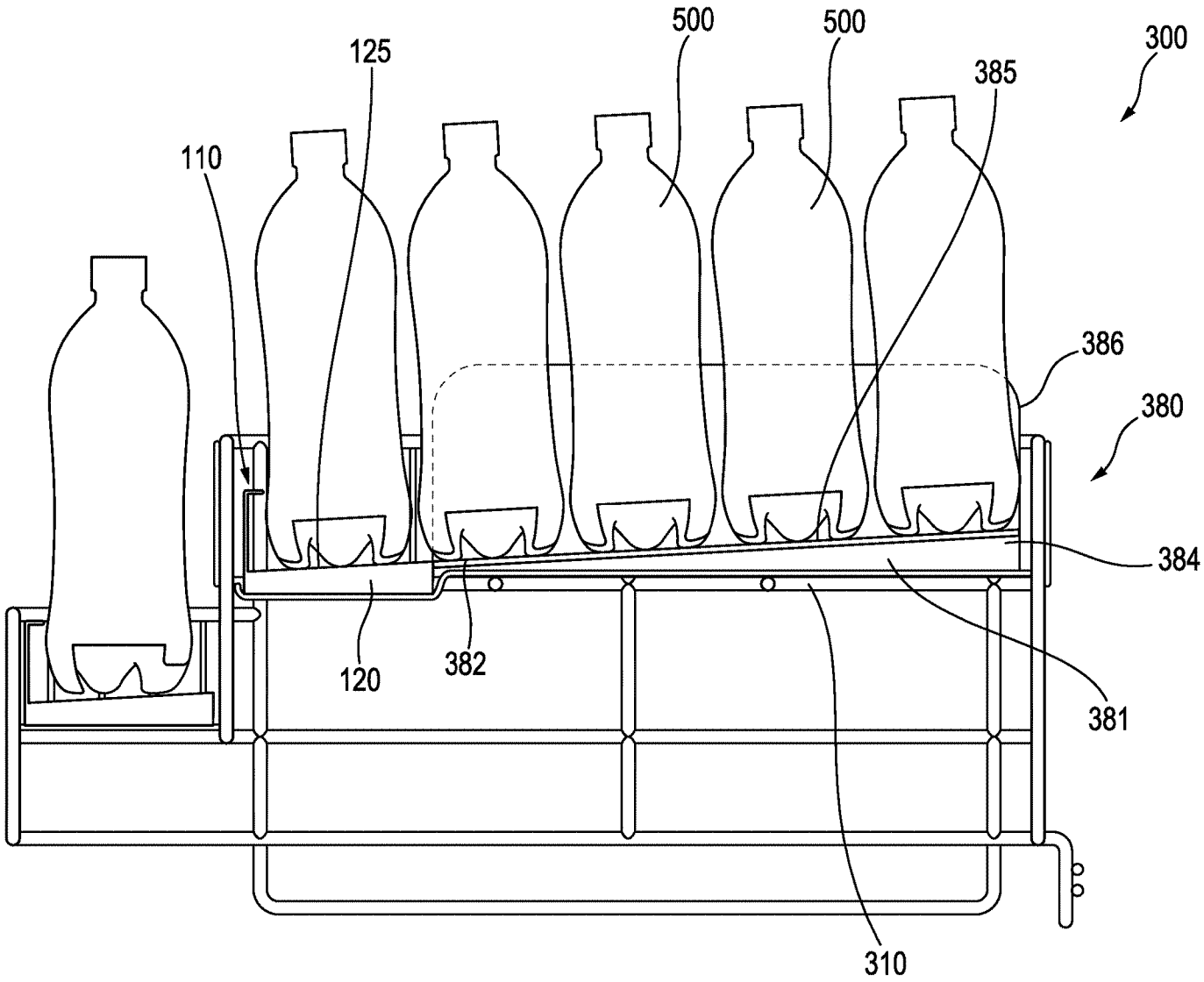
FIG. 14 shows a side cross sectional view of a display rack having a gravity dispenser according to an embodiment.

In some embodiments, display rack 300 may further include a gravity dispenser 380 configured to convey packaged beverages to a front of display rack 300 for easy access by consumers, as shown in FIG. 14. Gravity dispenser 380 may be arranged on first platform 310 which stores multiple rows of packaged beverages. Gravity dispenser 380 includes a base 381 having a front end 382 opposite a rear end 384. Base 381 may be shaped similarly to platform 310, and thus may have a square or rectangular shape. Base 381 may be downwardly sloped from rear end 384 toward front end 382 so that packaged beverages 500 arranged thereon slide from rear end 384 toward front end 382 under the force of gravity. Thus, base 381 may have a top surface 385 that is arranged at an angle relative to a horizontal plane of platform 310.

Gravity dispenser 380 may further include dividers 386 extending upward from base 381 to help maintain packaged beverages 500 in an upright orientation and to restrain lateral movement of packaged beverages 500 on platform 310, such that packaged beverages 500 may only move in a direction toward front end 382 of display rack 300. In some embodiments, panel 120 of display device 110 arranged at front end of platform 310 may similarly be sloped to allow packaged beverages 500 to slide from gravity dispenser 380 onto panel 120 and toward front end 122 of panel 120. Panel 120 of display device 110 and base 381 of gravity dispenser 380 may be sloped at the same angle. Top surface 125 of panel 120 may form a continuous surface with top 385 of base 381 so that packaged beverages 500 may readily slide from base 381 of gravity dispenser 380 onto panel 120 of display device 110 when a packaged beverage 500 in a front row of platform 310 is removed.

Figure 15:
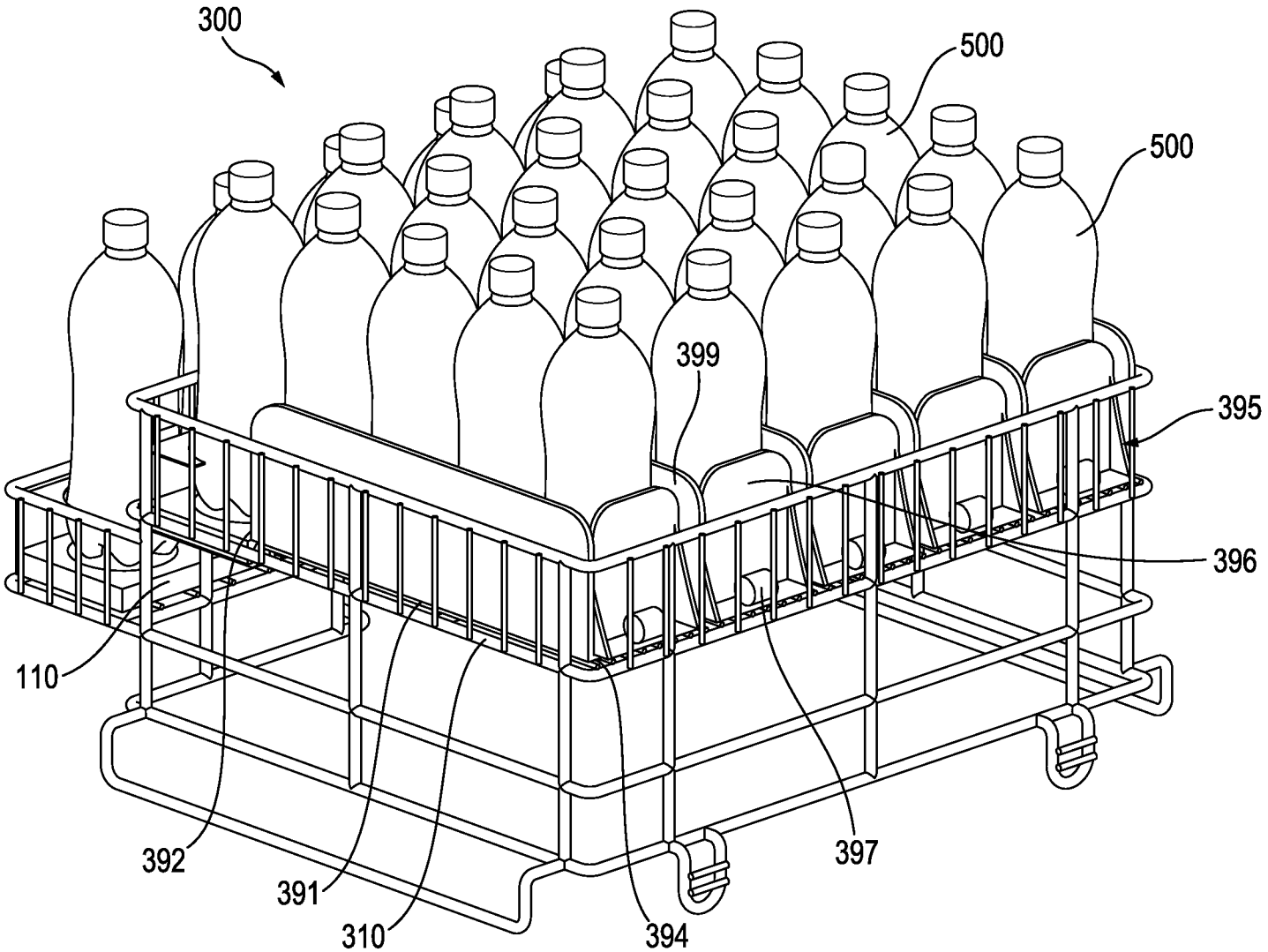
FIG. 15 shows a rear perspective view of a display rack having a spring-driven dispenser according to an embodiment.

In some embodiments, display rack 300 may include a spring-driven dispenser 390 for conveying packaged beverages toward a front end of display rack 300 for easy access by consumers, as shown in FIG. 15. Dispenser 390 may be arranged on first platform 310. Dispenser 390 may include a base 391 having a front end 392 opposite a rear end 394. Base 391 may be shaped similarly to platform 310 and thus may have a square or rectangular shape. Packaged beverages 500 may be arranged on base 391 of dispenser 390. A drive mechanism 395 may be arranged at rear end 394 of base 391 and may include a movable tab 396 and a spring 397. Tab 396 may be perpendicular to base 391 and may be movable along base 391 from rear end 394 toward front end 392. Spring 397 may bias tab 396 toward front end of base 391. Drive mechanism 395 may be configured to apply a force on packaged beverages 500 pushing packaged beverages 500 toward front end 312 of platform 310. Thus, as a packaged beverage 500 is removed from platform 310, drive mechanism 395 may automatically push the remaining packaged beverages 500 toward front end 312 of platform 310. Base 391 of dispenser 390 may be generally planar so that drive mechanism 395 controls movement of packaged beverages 500. However, in some embodiments, base 391 may slope downward from rear end 394 toward front end 392 so that packaged beverages 500 are also driven forward under the force of gravity. In some embodiments, dispenser 390 may further include dividers 399 extending from base 391 that separate adjacent columns of packaged beverages 500. Dividers 399 may restrain lateral movement of packaged beverages 500, such that packaged beverages 500 may only move in a direction toward front end 392 of base 391 to control the advance of packaged beverages 500.

Figure 16:
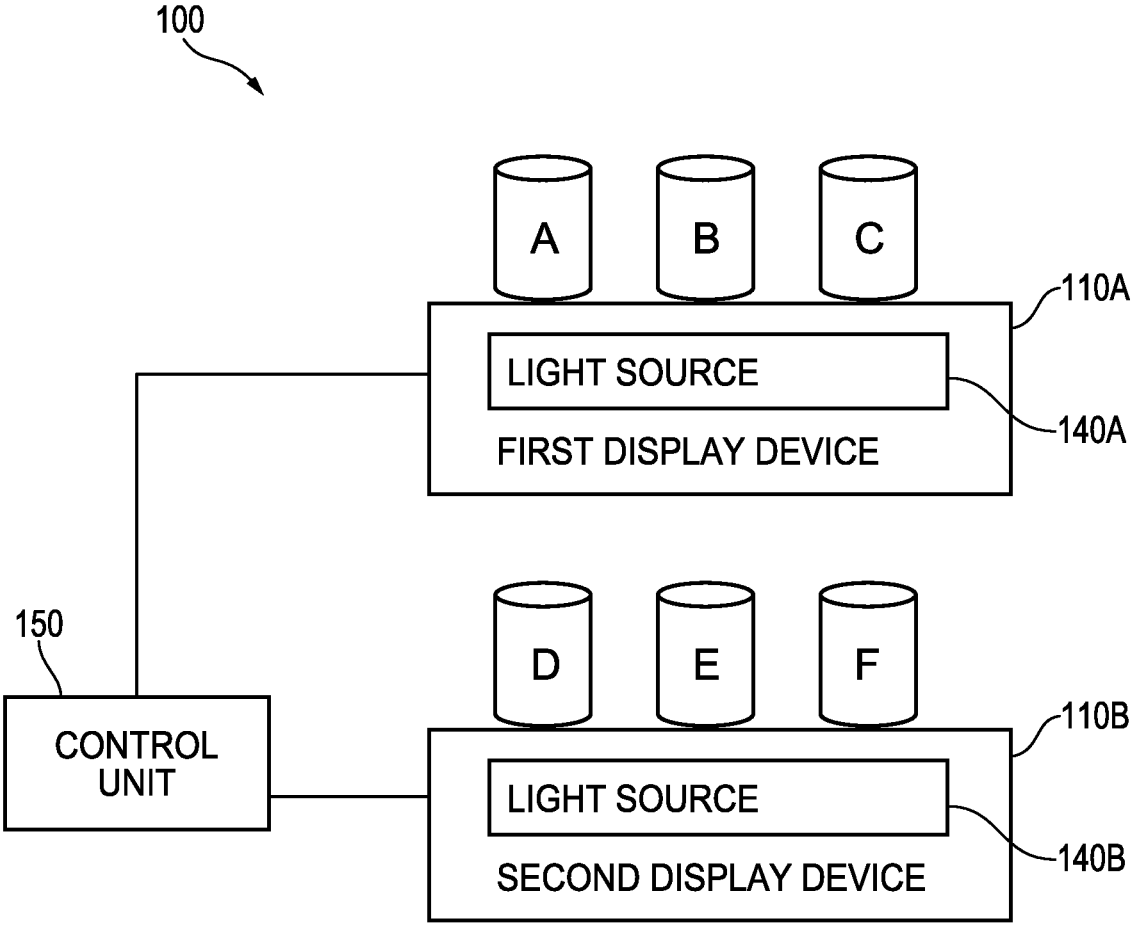
FIG. 16 shows a schematic diagram of a display system including multiple display devices according to an embodiment.

In some embodiments, a display device 110 may be in communication with a control unit 150 that controls illumination of light source 140 of display device 110, as shown in FIG. 16. Control unit 150 may be in communication with a plurality of display devices 110. Control unit 150 may control which display device 110 is illuminated, which portion of a light source 140 is illuminated, the color of the light, and the intensity of the light, among others. In some embodiments, a lighting system 100 may include a first display device 110A and a second display device 110B. Each display device 110A, 110B may be in communication with control unit 150, such as by wired or wireless communication.

Control unit 150 may cause display devices 110A, 110B to illuminate in a sequence or pattern. A light source 140 of a display device 110 may be illuminated in a pattern or to provide a visual effect. For example, control unit 150 may illuminate light source 140A to sequentially illuminate the bottles in a row, such that a first bottle A is illuminated, a second bottle B is illuminated as the first bottle A ceases to be illuminated, and a third bottle C is illuminated as the second bottle B ceases to be illuminated, and so on. Alternatively, the first bottle A may illuminate, the second bottle B may illuminate with the first bottle A still illuminated, and the third bottle C may illuminate with the first and second bottles A, B still illuminated. In another example, the light source 140A may illuminate bottles A, B, C at a low intensity and the intensity of illumination may increase to a maximum and then decrease to provide a pulsing effect. In another example, light source 140A may illuminate the bottles in the row in a random pattern, such as A, C, B, C, etc.

In some embodiments, a second display device 110B may also be in communication with control unit 150. Control unit 150 may control operation of both first display device 110A and second display device 110B. Control unit 150 may illuminate first display device 110A and subsequently illuminate second display device 110B. For example, each of bottles A, B, C may be illuminated, and then each of bottles D, E, F may be illuminated as A, B, C cease to be illuminated. In another example, the bottles in each row may illuminate sequentially such as by illuminated in order bottles A, B, C, D, E, and F. In another example, bottles may be illuminated in a random pattern e.g., E, A, C, D, B, F, etc.

Figure 17:
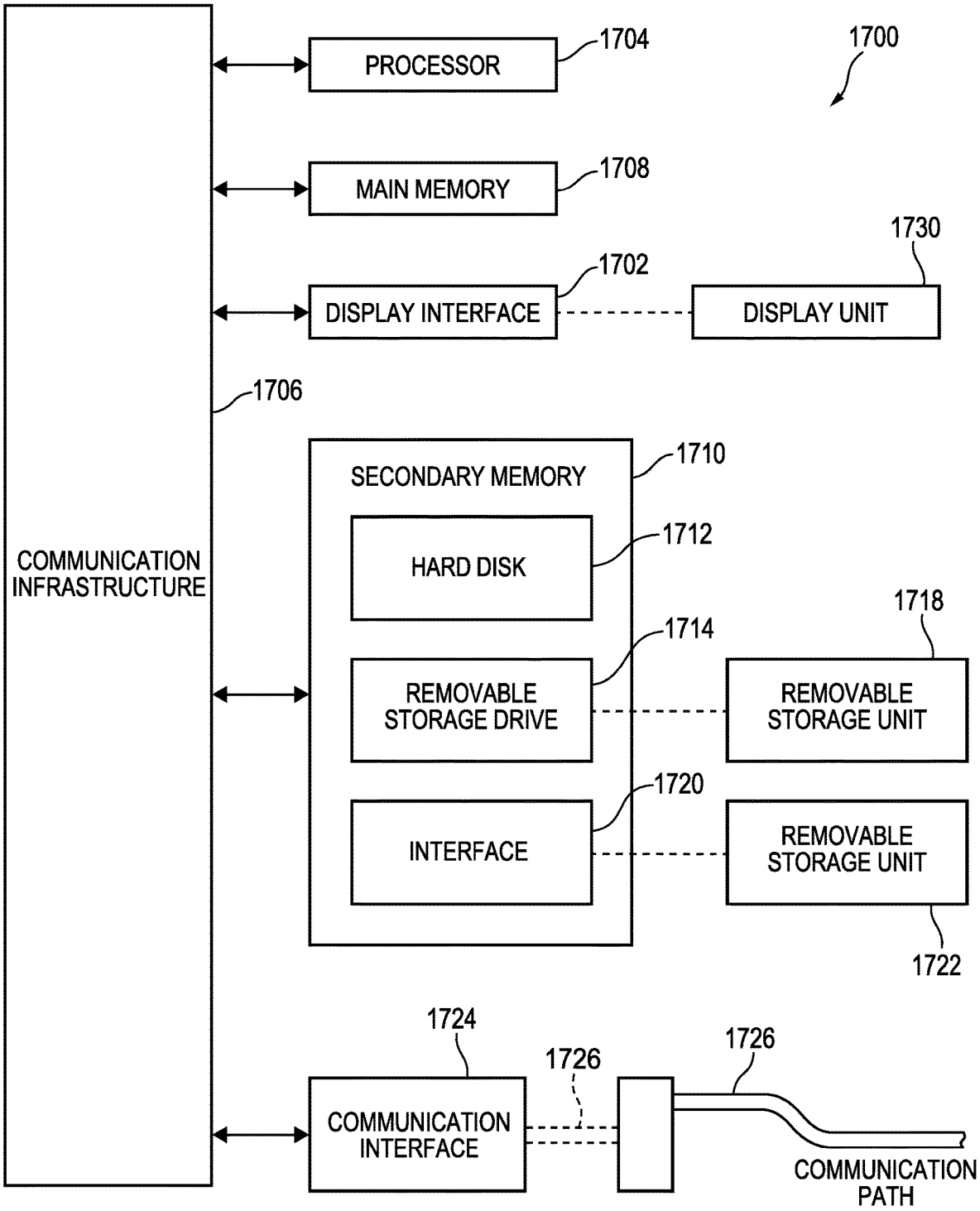
FIG. 17 shows a schematic block diagram of an exemplary computer system in which embodiments may be implemented.

FIG. 17 illustrates an exemplary computer system 1700 in which embodiments, or portions thereof, may be implemented as computer-readable code. Control unit 150 as discussed herein may be computer systems having all or some of the components of computer system 1700 for implementing processes discussed herein.

If programmable logic is used, such logic may execute on a commercially available processing platform or a special purpose device. One of ordinary skill in the art may appreciate that embodiments of the disclosed subject matter can be practiced with various computer system configurations, including multi-core multiprocessor systems, minicomputers, and mainframe computers, computer linked or clustered with distributed functions, as well as pervasive or miniature computers that may be embedded into virtually any device.

For instance, at least one processor device and a memory may be used to implement the above described embodiments. A processor device may be a single processor, a plurality of processors, or combinations thereof. Processor devices may have one or more processor "cores."

Various embodiments of the invention(s) may be implemented in terms of this example computer system 1700. After reading this description, it will become apparent to a person skilled in the relevant art how to implement one or more of the invention(s) using other computer systems and/or computer architectures. Although operations may be described as a sequential process, some of the operations may in fact be performed in parallel, concurrently, and/or in a distributed environment, and with program code stored locally or remotely for access by single or multi-processor machines. In addition, in some embodiments the order of operations may be rearranged without departing from the spirit of the disclosed subject matter.

Processor device 1704 may be a special purpose or a general purpose processor device. As will be appreciated by persons skilled in the relevant art, processor device 1704 may also be a single processor in a multi-core/multiprocessor system, such system operating alone, or in a cluster of computing devices operating in a cluster or server farm. Processor device 1704 is connected to a communication infrastructure 1706, for example, a bus, message queue, network, or multi-core message-passing scheme.

Computer system 1700 also includes a main memory 1708, for example, random access memory (RAM), and may also include a secondary memory 1710. Secondary memory 1710 may include, for example, a hard disk drive 1712, or removable storage drive 1714. Removable storage drive 1714 may include a floppy disk drive, a magnetic tape drive, an optical disk drive, a flash memory, or the like. The removable storage drive 1714 reads from and/or writes to a removable storage unit 1718 in a well-known manner. Removable storage unit 1718 may include a floppy disk, magnetic tape, optical disk, a universal serial bus (USB) drive, etc. which is read by and written to by removable storage drive 1714. As will be appreciated by persons skilled in the relevant art, removable storage unit 1718 includes a computer usable storage medium having stored therein computer software and/or data.

Computer system 1700 (optionally) includes a display interface 1702 (which can include input and output devices such as keyboards, mice, etc.) that forwards graphics, text, and other data from communication infrastructure 1706 (or from a frame buffer not shown) for display on display unit 1730.

In alternative implementations, secondary memory 1710 may include other similar means for allowing computer programs or other instructions to be loaded into computer system 1700. Such means may include, for example, a removable storage unit 1722 and an interface 1720. Examples of such means may include a program cartridge and cartridge interface (such as that found in video game devices), a removable memory chip (such as an EPROM, or PROM) and associated socket, and other removable storage units 1722 and interfaces 1720 which allow software and data to be transferred from the removable storage unit 1722 to computer system 1700.

Computer system 1700 may also include a communication interface 1724. Communication interface 1724 allows software and data to be transferred between computer system 1700 and external devices. Communication interface 1724 may include a modem, a network interface (such as an Ethernet card), a communication port, a PCMCIA slot and card, or the like. Software and data transferred via communication interface 1724 may be in the form of signals, which may be electronic, electromagnetic, optical, or other signals capable of being received by communication interface 1724. These signals may be provided to communication interface 1724 via a communication path 1726. Communication path 1726 carries signals and may be implemented using wire or cable, fiber optics, a phone line, a cellular phone link, an RF link or other communication channels.

In this document, the terms "computer program medium" and "computer usable medium" are used to generally refer to media such as removable storage unit 1718, removable storage unit 1722, and a hard disk installed in hard disk drive 1712. Computer program medium and computer usable medium may also refer to memories, such as main memory 1708 and secondary memory 1710, which may be memory semiconductors (e.g. DRAMs, etc.).

Computer programs (also called computer control logic) are stored in main memory 1708 and/or secondary memory 1710. Computer programs may also be received via communication interface 1724. Such computer programs, when executed, enable computer system 1700 to implement the embodiments as discussed herein. In particular, the computer programs, when executed, enable processor device 1704 to implement the processes of the embodiments discussed here. Accordingly, such computer programs represent controllers of the computer system 1700. Where the embodiments are implemented using software, the software may be stored in a computer program product and loaded into computer system 1700 using removable storage drive 1714, interface 1720, and hard disk drive 1712, or communication interface 1724.

Embodiments of the invention(s) also may be directed to computer program products comprising software stored on any computer useable medium. Such software, when executed in one or more data processing device, causes a data processing device(s) to operate as described herein. Embodiments of the invention(s) may employ any computer useable or readable medium. Examples of computer useable mediums include, but are not limited to, primary storage devices (e.g., any type of random access memory), secondary storage devices (e.g., hard drives, floppy disks, CD ROMS, ZIP disks, tapes, magnetic storage devices, and optical storage devices, MEMS, nanotechnological storage device, etc.).

It is to be appreciated that the Detailed Description section, and not the Summary and Abstract sections, is intended to be used to interpret the claims. The Summary and Abstract sections may set forth one or more but not all exemplary embodiments of the present invention(s) as contemplated by the inventors, and thus, are not intended to limit the present invention(s) and the appended claims in any way.

The present invention has been described above with the aid of functional building blocks illustrating the implementation of specified functions and relationships thereof. The boundaries of these functional building blocks have been arbitrarily defined herein for the convenience of the description. Alternate boundaries can be defined so long as the specified functions and relationships thereof are appropriately performed.

The foregoing description of the specific embodiments will so fully reveal the general nature of the invention(s) that others can, by applying knowledge within the skill of the art, readily modify and/or adapt for various applications such specific embodiments, without undue experimentation, and without departing from the general concept of the present invention(s). Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance herein.

What is claimed is:

1. A display system for packaged beverages, comprising:
a display rack, comprising:
a frame;
a stopper arranged on the frame for securing the display rack to a support surface:
a first platform arranged on the frame and configured to support the packaged beverages; and
a second platform configured to support the packaged beverages, wherein the second platform is arranged on the frame in a plane parallel to and spaced from a plane of the first platform;
a first display device arranged on the first platform; and
a second display device arranged on the second platform, wherein each of the first and second display devices comprises:
a panel comprising a front end opposite a rear end, and a top surface configured to support the packaged beverages; and
a light source arranged on the panel and beneath the packaged beverages for illuminating the packaged beverages.

2. The display system of claim 1, wherein the first platform comprises a channel configured to receive the first display device.

3. The display system of claim 1, further comprising a gravity dispenser arranged on the first platform, wherein the gravity dispenser comprises a base that is sloped.

4. The display system of claim 1, further comprising a spring—driven dispenser arranged on the first platform, wherein the spring—driven dispenser comprises a base and a tab driven by a spring.

5. The display system of claim 1, wherein the first and second display devices are each in communication with a control unit configured to selectively illuminate the first and second display devices.

6. A display device for illuminating a packaged beverage, comprising:

a panel configured to support the packaged beverage, wherein the panel comprises a front end opposite a rear end, and a top surface having a plurality of transparent portions;

a light source arranged within the panel for illuminating the packaged beverage arranged on the panel; and an end cap comprising a front wall arranged at the front end of the panel, wherein the end cap further comprises a flange extending from the front wall of the end cap such that the flange is parallel to the panel.

7. The device of claim 6, wherein the flange comprises a plurality of cutouts.

8. The device of claim 6, wherein the panel comprises a baseplate and a top plate, wherein the top plate defines the top surface.

9. The device of claim 6, wherein the light source comprises a light guide.

10. The device of claim 6, wherein the light source comprises a plurality of light emitting diodes.

11. The device of claim 6, further comprising a power connector configured to place the display device in electrical connection with a power source.

12. The device of claim 11, wherein the power connector comprises a spring—biased probe.

13. A display cabinet for displaying a packaged beverage, comprising:

a housing defining a storage compartment configured to store the packaged beverage, wherein the storage compartment comprises a first side opposite a second side and a front end opposite a rear end;

a shelf arranged within the storage compartment and extending between the first side and the second side; and a display device extending along the shelf at the front end of the storage compartment between the first side and the second side, wherein the display device comprises:

a panel comprising a front end opposite a rear end, and a top surface having a plurality of transparent portions, wherein the top surface is configured to support the packaged beverage, a light source for illuminating the packaged beverage, wherein the light source is arranged within the panel, and an end cap comprising a front wall arranged at the front end of the panel, wherein the end cap further comprises a flange extending from the front wall of the end cap such that the flange is parallel to the panel.

14. The display cabinet of claim 13, wherein the flange comprises a plurality of cutouts.

15. The display cabinet of claim 13, wherein the shelf comprises a channel in which the display device is arranged.

16. The display cabinet of claim 13, further comprising a power bar arranged along an inner wall of the storage compartment at a front end of the storage compartment, wherein the power bar is configured to provide electrical energy to the display device.

17. The display cabinet of claim 16, wherein the display device further comprises a power connector configured to contact the power bar to place the display device in electrical connection with the power bar when the display device is installed within the storage compartment.

18. A display cabinet for displaying a packaged beverage, comprising:

a housing defining a storage compartment configured to store the packaged beverage, wherein the storage compartment comprises a first side opposite a second side and a front end opposite a rear end;

a shelf arranged within the storage compartment and extending between the first side and the second side;

a display device extending along the shelf at the front end of the storage compartment between the first side and the second side, wherein the display device comprises:

a panel comprising a front end opposite a rear end, and a top surface having a plurality of transparent portions, wherein the top surface is configured to support the packaged beverage, and a light source for illuminating the packaged beverage, wherein the light source is arranged within the panel; and a power bar arranged along an inner wall of the storage compartment at a front end of the storage compartment, wherein the power bar is configured to provide electrical energy to the display device.

19. The display cabinet of claim 18, wherein the display device further comprises a power connector configured to contact the power bar to place the display device in electrical connection with the power bar when the display device is installed within the storage compartment.

* * * * *